US008128436B2

(12) United States Patent
Bopp et al.

(10) Patent No.: US 8,128,436 B2
(45) Date of Patent: Mar. 6, 2012

(54) ELECTRICAL CONNECTORS WITH CROSSTALK COMPENSATION

(75) Inventors: Steven Richard Bopp, Jamestown, NC (US); Paul John Pepe, Jamestown, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 367 days.

(21) Appl. No.: 12/547,211

(22) Filed: Aug. 25, 2009

(65) Prior Publication Data

US 2011/0053430 A1 Mar. 3, 2011

(51) Int. Cl.
*H01R 24/00* (2011.01)

(52) U.S. Cl. ..... 439/676; 439/941

(58) Field of Classification Search ..... 439/676, 439/344, 941, 76.1, 668, 620.11, 620.13, 439/620.21–620.23, 79
See application file for complete search history.

(56) References Cited

U.S. PATENT DOCUMENTS

| | | | |
|---|---|---|---|
| 5,299,956 | A | 4/1994 | Brownell et al. |
| 5,310,363 | A | 5/1994 | Brownell et al. |
| 5,432,484 | A | 7/1995 | Klas et al. |
| 5,454,738 | A | 10/1995 | Lim et al. |
| 5,470,244 | A | 11/1995 | Lim et al. |
| 5,700,167 | A | 12/1997 | Pharney et al. |
| 5,967,853 | A | 10/1999 | Hashim |
| 5,997,358 | A | 12/1999 | Adriaenssens et al. |
| 6,089,923 | A | 7/2000 | Phommachanh |
| 6,107,578 | A | 8/2000 | Hashim |
| 6,116,964 | A | 9/2000 | Goodrich et al. |
| 6,116,965 | A | 9/2000 | Arnett et al. |
| 6,139,371 | A | 10/2000 | Troutman et al. |
| 6,186,834 | B1 | 2/2001 | Arnett et al. |
| 6,231,397 | B1 | 5/2001 | de la Borbolla et al. |
| 6,270,381 | B1 | 8/2001 | Adriaenssens et al. |
| 6,317,011 | B1 | 11/2001 | Barnett et al. |
| 6,350,158 | B1 | 2/2002 | Arnett et al. |
| 6,443,777 | B1 | 9/2002 | McCurdy et al. |
| 6,464,541 | B1 | 10/2002 | Hashim et al. |
| 6,522,152 | B1 | 2/2003 | Tonti et al. |

(Continued)

FOREIGN PATENT DOCUMENTS

EP 0901201 3/1999

(Continued)

OTHER PUBLICATIONS

Annex to Form PCT/ISA/206, Communication Relating to the Results of the Partial International Search, Int'l Appln. No. PCT/2010/002279, Int'l Filing Date Aug. 19, 2010.

(Continued)

*Primary Examiner* — Edwin A. Leon

(57) ABSTRACT

An electrical connector including mating conductors configured to engage select plug contacts of a modular plug. The connector includes a printed circuit that interconnects the mating conductors to terminal contacts. The printed circuit includes first and second shielding rows of conductor vias that are located between end portions of the printed circuit and are electrically connected to the mating conductors. The first and second shielding rows extend along first and second row axes, respectively, which extend substantially parallel to each other. The printed circuit also includes outer terminal vias electrically connected to the terminal contacts. Each end portion has terminal vias therein that are distributed in a direction along the first and second row axes. The printed circuit also includes a pair of shielded vias located between the first and second shielding rows and along a central-pair axis that extends substantially parallel to the first and second row axes.

20 Claims, 14 Drawing Sheets

U.S. PATENT DOCUMENTS

| | | | | |
|---|---|---|---|---|
| 6,558,207 | B1 | 5/2003 | Pepe et al. | |
| 6,840,779 | B2 | 1/2005 | Eberle et al. | |
| 6,840,816 | B2 | 1/2005 | Aekins | |
| 6,866,548 | B2 | 3/2005 | Hashim | |
| 7,038,554 | B2 | 5/2006 | Seefried | |
| 7,074,092 | B1 | 7/2006 | Green et al. | |
| 7,140,024 | B2 | 11/2006 | Kaulgud et al. | |
| 7,140,924 | B2 | 11/2006 | Redfield et al. | |
| 7,153,168 | B2 | 12/2006 | Caveney et al. | |
| 7,166,000 | B2 | 1/2007 | Pharney | |
| 7,182,649 | B2 | 2/2007 | Caveney et al. | |
| 7,190,594 | B2 | 3/2007 | Hashim et al. | |
| 7,201,618 | B2 | 4/2007 | Ellis et al. | |
| 7,281,957 | B2 | 10/2007 | Caveney | |
| 7,294,025 | B1 | 11/2007 | Chen | |
| 7,309,261 | B2 | 12/2007 | Caveney et al. | |
| 7,314,393 | B2 | 1/2008 | Hashim | |
| 7,357,683 | B2 | 4/2008 | Caveney et al. | |
| 7,364,470 | B2 | 4/2008 | Hashim | |
| 7,367,849 | B2 | 5/2008 | Wang et al. | |
| 7,381,098 | B2 | 6/2008 | Hammond, Jr. et al. | |
| 7,402,085 | B2 | 7/2008 | Hammond, Jr. et al. | |
| 7,407,417 | B2 | 8/2008 | Pepe et al. | |
| 7,410,367 | B2 | 8/2008 | Hashim et al. | |
| 7,442,092 | B2 | 10/2008 | Caveney et al. | |
| 7,452,246 | B2 | 11/2008 | Caveney et al. | |
| 7,481,678 | B2 | 1/2009 | Aekins | |
| 7,481,681 | B2 | 1/2009 | Caveney et al. | |
| 7,575,482 | B1 | 8/2009 | Pepe et al. | |
| 7,658,651 | B2 | 2/2010 | Pepe et al. | |
| 7,837,513 | B2 * | 11/2010 | Millette et al. | 439/676 |
| 7,857,635 | B2 * | 12/2010 | Goodrich et al. | 439/76.1 |
| 7,874,879 | B2 * | 1/2011 | Caveney et al. | 439/676 |
| 2001/0008189 | A1 | 7/2001 | Reede | |
| 2004/0146002 | A1 | 7/2004 | Azadet | |
| 2005/0136747 | A1 | 6/2005 | Caveney et al. | |
| 2006/0134992 | A1 | 6/2006 | Green et al. | |
| 2007/0117469 | A1 | 5/2007 | Caveney et al. | |
| 2007/0123112 | A1 | 5/2007 | Caveney et al. | |
| 2007/0212945 | A1 | 9/2007 | Wang et al. | |
| 2007/0212946 | A1 | 9/2007 | Bert et al. | |
| 2007/0293094 | A1 | 12/2007 | Aekins | |
| 2008/0239937 | A1 | 10/2008 | Erickson et al. | |
| 2008/0268710 | A1 | 10/2008 | Hashim et al. | |
| 2008/0311778 | A1 | 12/2008 | Aekins | |
| 2010/0041278 | A1 | 2/2010 | Bopp et al. | |

FOREIGN PATENT DOCUMENTS

| | | |
|---|---|---|
| EP | 0940890 | 9/1999 |
| EP | 1406354 | 4/2004 |
| EP | 1596478 | 11/2005 |
| GB | 2 438 746 A | 12/2007 |
| WO | 2007009020 | 1/2007 |
| WO | 2009131640 | 10/2009 |

OTHER PUBLICATIONS

International Search Report, International Search Report No. PCT/US2010/002285, International Filing Date Aug. 19, 2010.

International Search Report, International Search Report No. PCT/US2010/002278, International Filing Date Aug. 19, 2010.

* cited by examiner

ELECTRICAL CONNECTORS WITH CROSSTALK COMPENSATION

CROSS-REFERENCE TO RELATED APPLICATIONS

The subject matter described herein includes subject matter similar to subject matter described in U.S. patent application Ser. No. 12/547,321 entitled "ELECTRICAL CONNECTOR WITH SEPARABLE CONTACTS", and U.S. patent application Ser. No. 12/547,245 entitled "ELECTRICAL CONNECTOR HAVING AN ELECTRICALLY PARALLEL COMPENSATION REGION", both of which are filed contemporaneously herewith and are incorporated by reference in their entirety.

BACKGROUND OF THE INVENTION

The subject matter herein relates generally to electrical connectors, and more particularly, to electrical connectors that utilize differential pairs and experience offending crosstalk and/or return loss.

The electrical connectors that are commonly used in telecommunication systems, such as modular jacks and modular plugs, may provide interfaces between successive runs of cable in such systems and between cables and electronic devices. The electrical connectors may include mating conductors that are arranged according to known industry standards, such as Electronics Industries Alliance/Telecommunications Industry Association ("EIA/TIA")-568. However, the performance of the electrical connectors may be negatively affected by, for example, near-end crosstalk (NEXT) loss and/or return loss. In order to improve the performance of the connectors, techniques are used to provide compensation for the NEXT loss and/or to improve the return loss.

Such techniques have focused on arranging the mating conductors with respect to each other within the electrical connector and/or introducing components to provide the compensation, e.g., compensating NEXT. For example, compensating signals may be created by crossing the conductors such that a coupling polarity between the two conductors is reversed. Compensating signals may also be created in a circuit board of the electrical connector by capacitively coupling digital fingers to one another. However, the above techniques may have limited capabilities for providing crosstalk compensation and/or improving return loss.

Thus, there is a need for additional techniques to improve the electrical performance of the electrical connector by reducing crosstalk and/or by improving return loss.

BRIEF DESCRIPTION OF THE INVENTION

In one embodiment, an electrical connector is provided that includes an array of mating conductors configured to engage select plug contacts of a modular plug. The mating conductors include differential pairs. The connector also includes a plurality of terminal contacts that are configured to electrically connect to select cable wires and a printed circuit that interconnects the mating conductors to the terminal contacts. The printed circuit has opposite end portions and also includes first and second shielding rows of conductor vias that are located between the end portions and are electrically connected to the mating conductors. The conductor vias of each of the first and second shielding rows is substantially aligned along first and second row axes, respectively. The first and second row axes are substantially parallel to each other. The printed circuit also includes outer terminal vias that are electrically connected to the terminal contacts. Each end portion has terminal vias therein that are distributed in a direction along the first and second row axes. The printed circuit also includes a pair of shielded vias that are electrically connected to corresponding mating conductors. The pair of shielded vias are located between the first and second shielding rows and located along a central-pair axis extending therebetween. The central-pair axis extends substantially parallel to the first and second row axes. The conductor vias of the first and second shielding rows are located to electrically isolate the shielded vias from the terminal vias.

In another embodiment, an electrical connector configured to electrically interconnect a modular plug and cable wires is provided. The connector includes a connector body that has an interior chamber configured to receive the modular plug. The connector also includes a printed circuit that includes a substrate having conductor vias. The connector further includes an array of mating conductors in the interior chamber configured to engage select plug contacts of the modular plug along mating interfaces. The mating conductors extend between the mating interfaces and corresponding conductor vias of the printed circuit. The mating conductors have a cross-section including a width and a thickness. The mating conductors comprise adjacent mating conductors having respective coupling regions that capacitively couple to each other. Each coupling region has a side that extends along the thickness and faces the side of the coupling region of the adjacent mating conductor. The thickness along each coupling region is greater than the width.

DETAILED DESCRIPTION OF THE INVENTION

Figure 1:
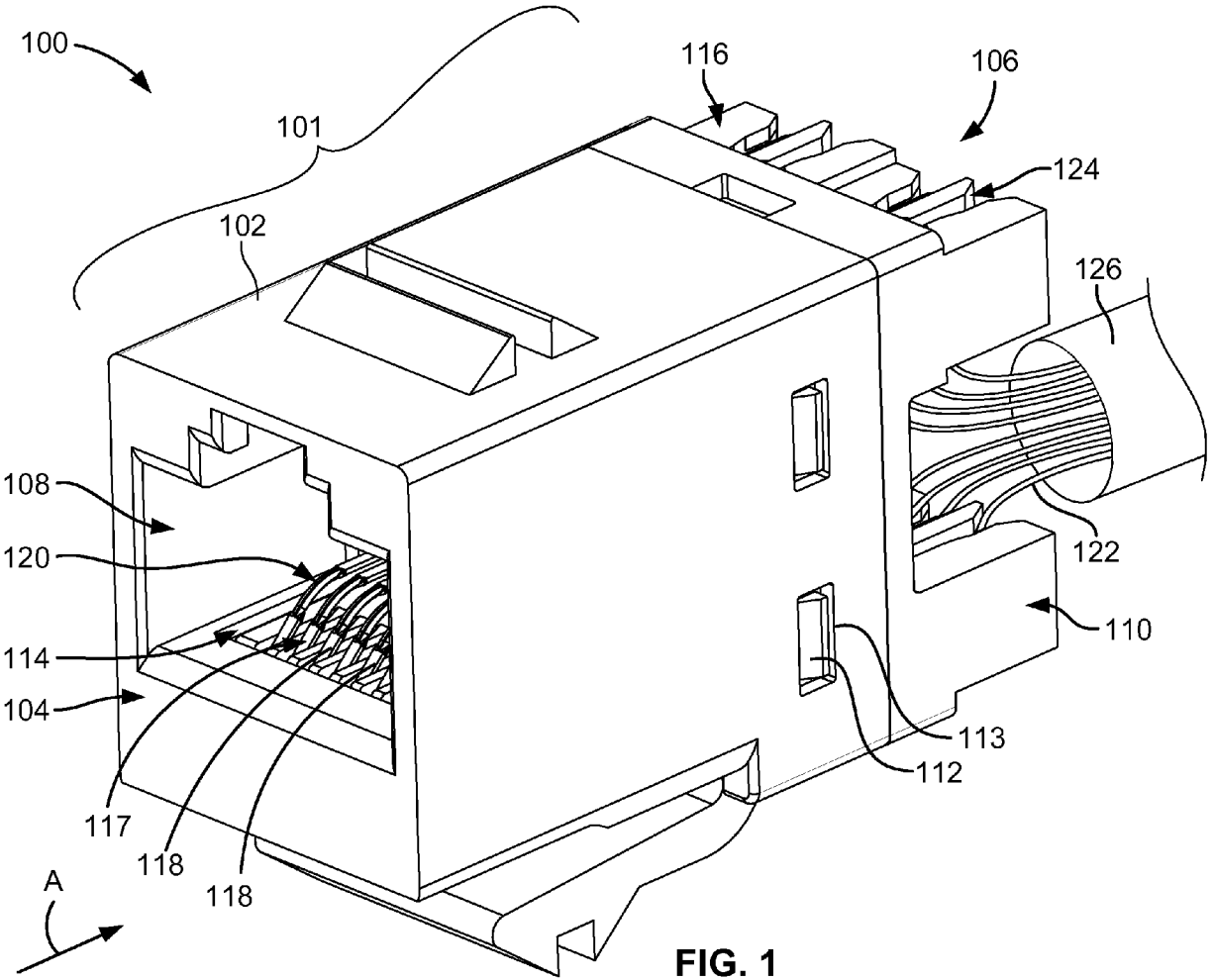
FIG. 1 is perspective view of an electrical connector formed in accordance with one embodiment.

FIG. 1 is a perspective view of an exemplary embodiment of an electrical connector 100. In the exemplary embodiment, the connector 100 is a modular connector, such as, but not limited to, an RJ-45 outlet or communication jack. However, the subject matter described and/or illustrated herein is applicable to other types of electrical connectors. The connector 100 is configured to receive and engage a mating or modular plug 145 (shown in FIG. 4) (also referred to as a mating connector). The modular plug 145 is loaded along a mating direction, shown generally by arrow A. The connector 100 includes a connector body 101 having a mating end 104 that is configured to receive and engage the modular plug 145 and a loading end 106 that is configured to electrically and mechanically engage a cable 126. The connector body 101 may include a housing 102 extending from the mating end 104 and toward the loading end 106. The connector body 101 or housing 102 may at least partially define an interior chamber 108 that extends therethrough and is configured to receive the modular plug 145 proximate the mating end 104.

Figure 2:
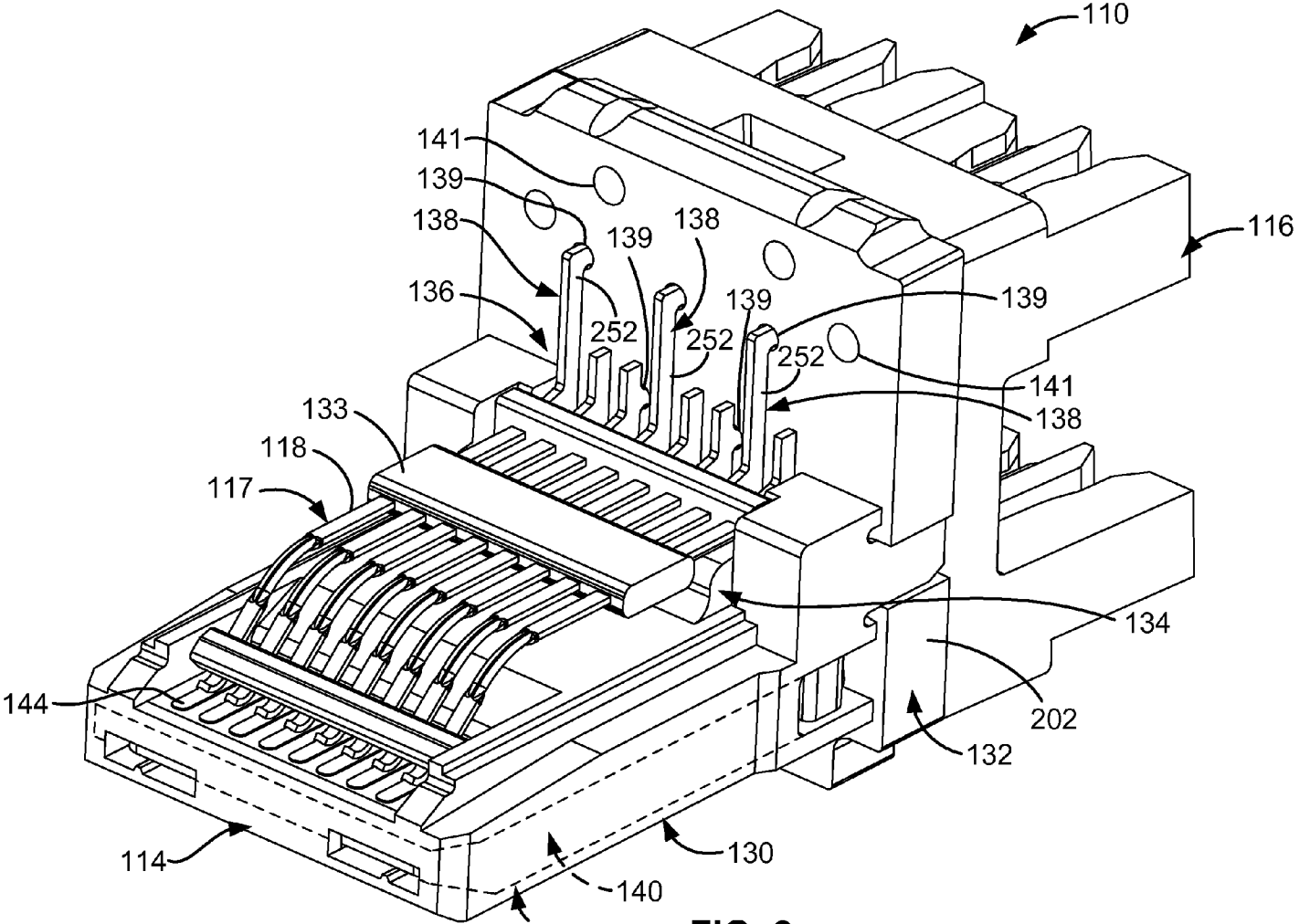
FIG. 2 is a perspective view of an exemplary embodiment of a contact sub-assembly of the connector shown in FIG. 1.

The connector 100 includes a contact sub-assembly 110 received within the housing 102 proximate to the loading end 106. In the exemplary embodiment, the contact sub-assembly 110 is secured to the housing 102 via tabs 112 that cooperate with corresponding openings 113 within the housing 102. The contact sub-assembly 110 extends from a mating end portion 114 to a terminating end portion 116. The contact sub-assembly 110 is held within the housing 102 such that the mating end portion 114 of the contact sub-assembly 110 is positioned proximate the mating end 104 of the housing 102. The terminating end portion 116 in the exemplary embodiment is located proximate to the loading end 106. As shown, the contact sub-assembly 110 includes an array 117 of mating conductors or contacts 118. Each mating conductor 118 within the array 117 includes a mating surface 120 arranged within the chamber 108. The mating conductors 118 extend between the corresponding mating surfaces 120 and corresponding conductor vias 139 (FIG. 2) in a printed circuit 132 (FIG. 2). Each mating surface 120 engages (i.e., interfaces with) a select mating or plug contact 146 (shown in FIG. 4) of the modular plug 145 when the modular plug 145 is mated with the connector 100.

In some embodiments, the arrangement of the mating conductors 118 may be at least partially determined by industry standards, such as, but not limited to, International Electrotechnical Commission (IEC) 60603-7 or Electronics Industries Alliance/Telecommunications Industry Association (EIA/TIA)-568. In an exemplary embodiment, the connector 100 includes eight mating conductors 118 comprising four differential pairs. However, the connector 100 may include any number of mating conductors 118, whether or not the mating conductors 118 are arranged in differential pairs.

In the exemplary embodiment, a plurality of cable wires 122 are attached to terminating portions 124 of the contact sub-assembly 110. The terminating portions 124 are located at the terminating end portion 116 of the contact sub-assembly 110. Each terminating portion 124 may be electrically connected to a corresponding one of the mating conductors 118. The wires 122 extend from the cable 126 and are terminated at the terminating portions 124. Optionally, the terminating portions 124 include insulation displacement contacts (IDCs) for electrically connecting the wires 122 to the contact sub-assembly 110. Alternatively, the wires 122 may be terminated to the contact sub-assembly 110 via a soldered connection, a crimped connection, and/or the like. In the exemplary embodiment, eight wires 122 arranged as differential pairs are terminated to the connector 100. However, any number of wires 122 may be terminated to the connector 100, whether or not the wires 122 are arranged in differential pairs. Each wire 122 is electrically connected to a corresponding one of the mating conductors 118. Accordingly, the connector 100 may provide electrical signal, electrical ground, and/or electrical power paths between the modular plug 145 and the wires 122 via the mating conductors 118 and the terminating portions 124.

Figure 4:
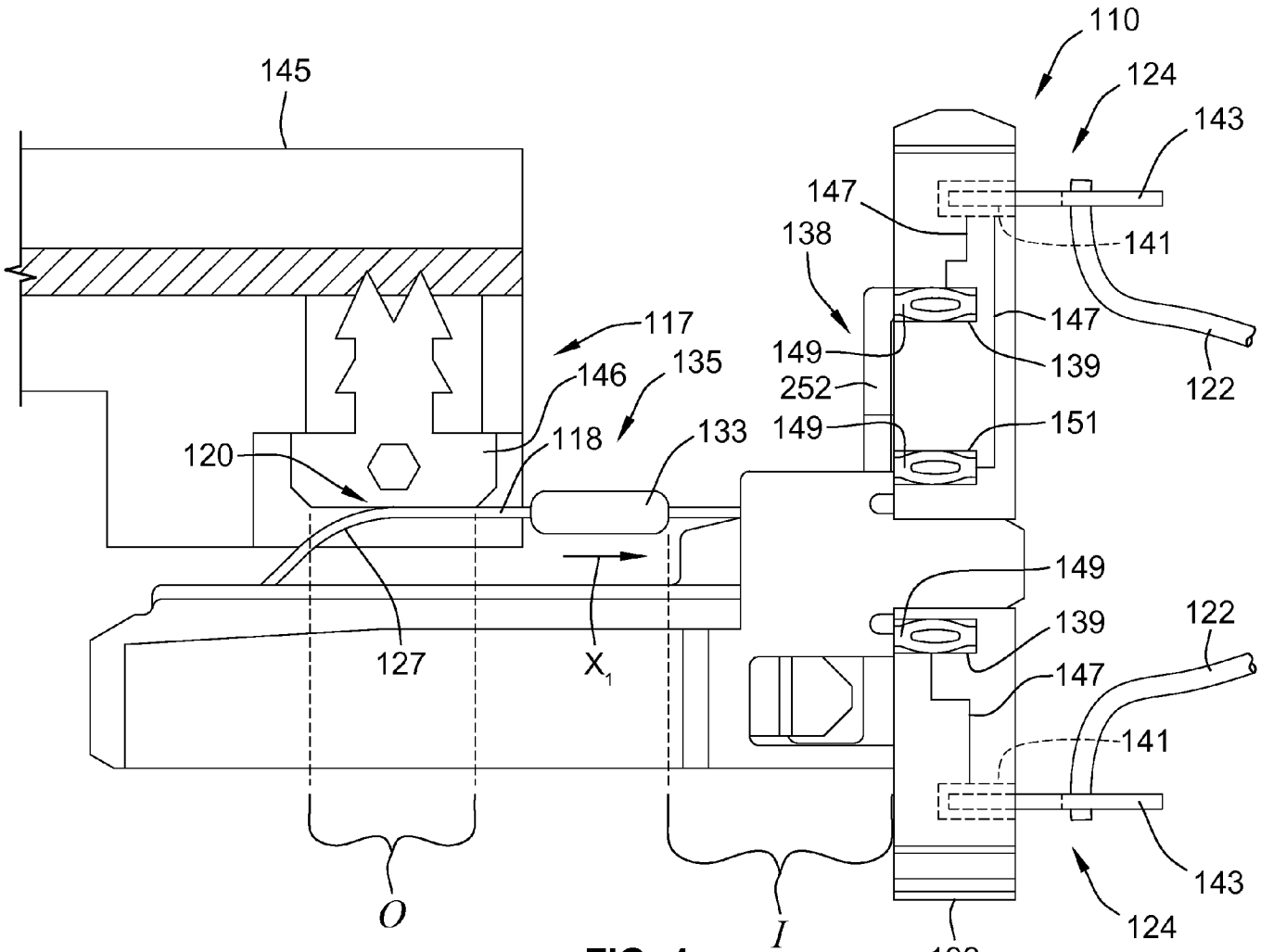
FIG. 4 is a schematic side view of a contact sub-assembly when a modular plug is engaged with the connector of FIG. 1.

FIG. 2 is a perspective view of an exemplary embodiment of the contact sub-assembly 110. The contact sub-assembly 110 includes a base 130 extending from the mating end portion 114 to a printed circuit 132 proximate the terminating end portion 116, which is located proximate to the loading end 106 (FIG. 1) when the connector 100 (FIG. 1) is fully assembled. As used herein, the term "printed circuit" includes any electric circuit in which conductive pathways have been printed or otherwise deposited in predetermined patterns on a dielectric substrate. For example, the printed circuit 132 may be a circuit board or a flex circuit having a substrate 202. The contact sub-assembly 110 holds the array 117 of mating conductors 118 such that the mating conductors 118 extend in a direction that is generally parallel to the loading direction (shown in FIG. 1 by arrow A) of the modular plug 145 (FIG. 4). Optionally, the base 130 includes a supporting block 134 positioned proximate to the printed circuit 132 and a band 133 of dielectric material that is configured to facilitate supporting or holding the mating conductors 118 in a predetermined arrangement.

Figure 5:
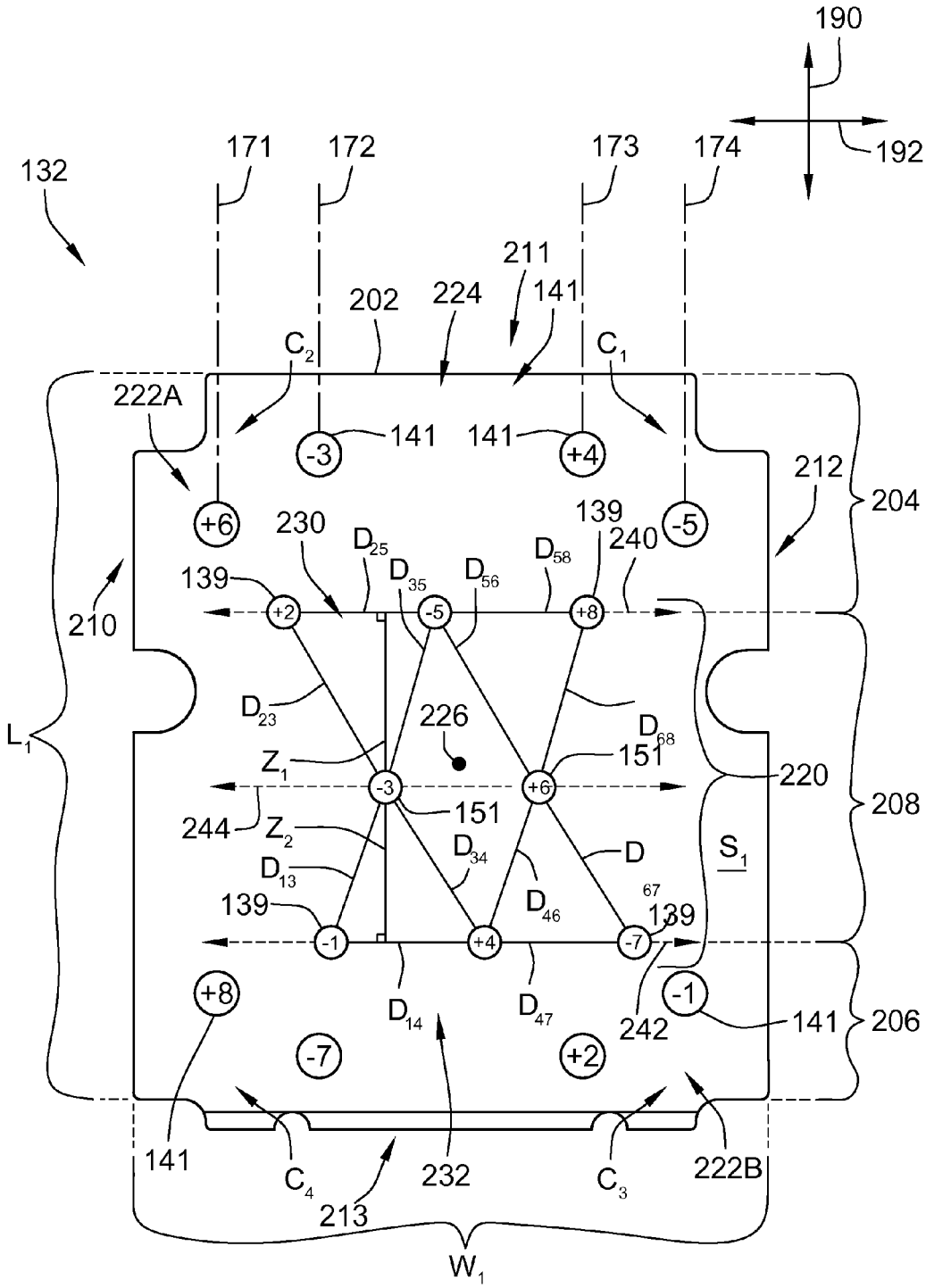
FIG. 5 is an elevation view of a printed circuit that may be used with the connector of FIG. 1.

Also shown, the printed circuit 132 may electrically engage the mating conductors 118 through corresponding conductor vias 139 and shielded vias 151 (shown in FIG. 5). Specifically, the mating conductors 118 may have circuit contact portions 252 proximate to the printed circuit 132 that electrically connect to the corresponding conductor and shielded vias 139 and 151. The conductor and shielded vias 139 and 151 may be electrically connected to corresponding terminal vias 141 through corresponding traces (e.g., traces 481-488 shown in FIG. 12).

Adjacent mating conductors 118 may have coupling regions 138 that are configured to capacitively couple to one another. As used herein, a "coupling region" of a mating conductor includes dimensions that are configured to substantially affect the electromagnetic coupling of the corresponding mating conductor to other mating conductors and/or the printed circuit. In the exemplary embodiment shown in FIG. 2, the circuit contact portions 252 include the coupling regions 138; however, the coupling regions 138 may be in other portions of the mating conductors 118 in other embodiments. The coupling regions 138 may be located proximate to the printed circuit 132.

The terminal vias 141 may be electrically connected to a plurality of terminal contacts 143 (shown in FIG. 4). Each terminal contact 143 may mechanically engage and electrically connect to a select wire 122 (FIG. 1) proximate the loading end 106 (FIG. 1). The arrangement or pattern of the conductor and shielded vias 139 and 151 with respect to each other and to the terminal vias 141 within the printed circuit 132 may be configured for a desired electrical performance. Furthermore, the traces (described below) that electrically connect the terminal vias 141 to the conductor and shielded vias 139 and 151 may also be configured to tune or obtain a desired electrical performance of the connector 100.

The contact sub-assembly 110 may also include a compensation component 140 (indicated by dashed-lines) that extends between the mating end portion 114 and the terminating end portion 116. The compensation component 140 may be received within a cavity 142 of the base 130. The mating conductors 118 may be electrically connected to the compensation component 140 proximate to the mating end portion 114 and/or the terminating end portion 116. For example, the mating conductors 118 may be electrically connected to the compensation component 140 through contact pads 144 proximate to the mating end portion 114. Although not shown, the mating conductors 118 may also be electrically connected to the compensation component 140 through other contact pads (not shown) located toward the terminating end portion 116 of the compensation component 140.

Figure 3:
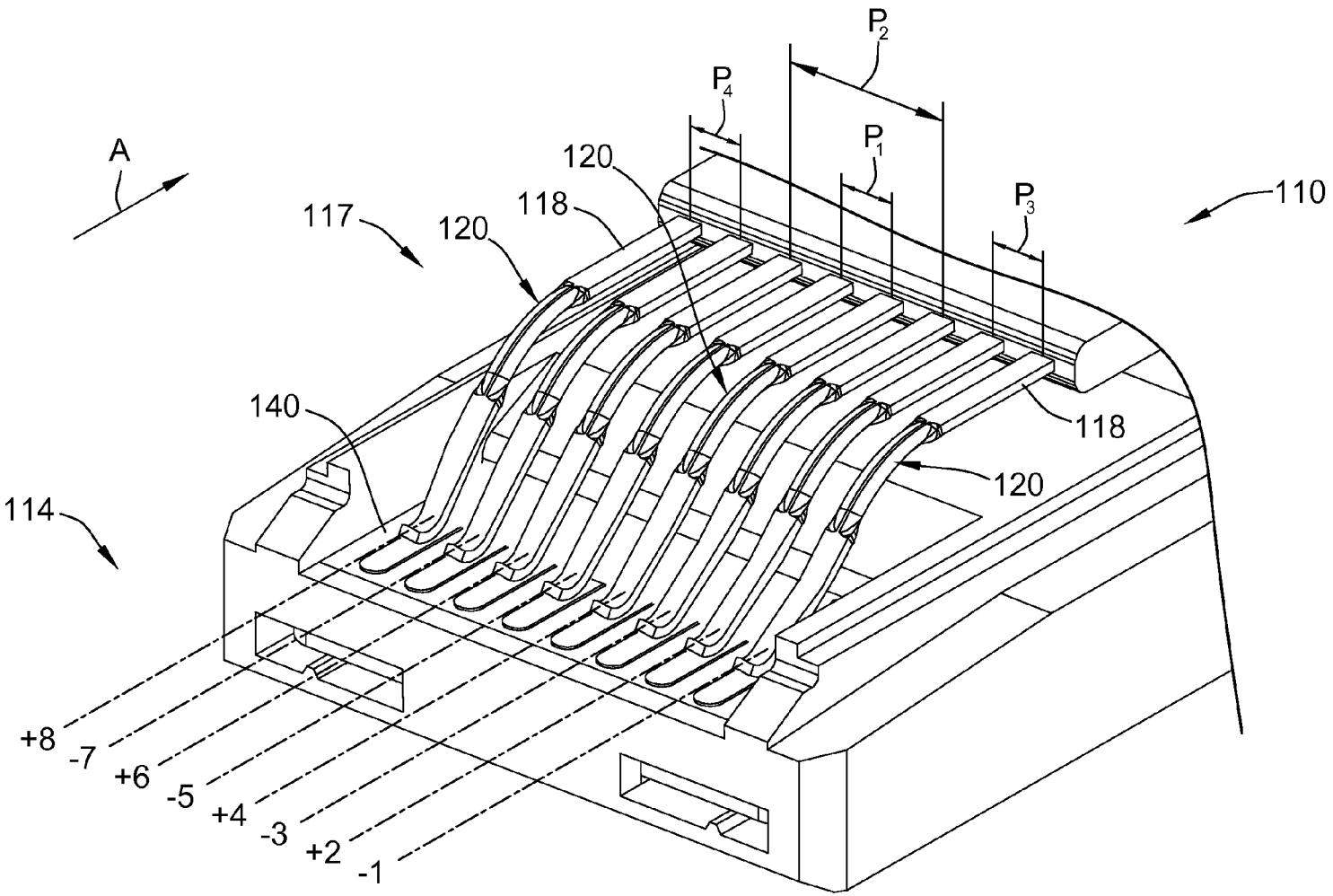
FIG. 3 is an enlarged perspective view of a mating end of the contact sub-assembly shown in FIG. 2.

FIG. 3 is an enlarged perspective view of the mating end portion 114 of the contact sub-assembly 110. By way of example, the array 117 may include eight mating conductors 118 that are arranged as a plurality of differential pairs P1-P4. Each differential pair P1-P4 consists of two associated mating conductors 118 in which one mating conductor 118 transmits a signal current and the other mating conductor 118 transmits a signal current that is about 180° out of phase with the associated mating conductor. By convention, the differential pair P1 includes mating conductors +4 and −5; the differential pair P2 includes mating conductors +6 and −3; the differential pair P3 includes mating conductors +2 and −1; and the differential pair P4 includes mating conductors +8 and −7. As used herein, the (+) and (−) represent positive and negative polarities of the mating conductors. A mating conductor labeled (+) is opposite in polarity to a mating conductor labeled (−), and, as such, the mating conductor labeled (−) carries a signal that is about 180° out of phase with the mating conductor labeled (+). Mating conductors may also be characterized as having a signal path or a return path where the signal and return paths carry signals that are about 180° out of phase with each other.

As shown in FIG. 3, the mating conductors +6 and −3 of the differential pair P2 are separated by the mating conductors +4 and −5 that form the differential pair P1. As such, the mating conductors +6 and −3 of the differential pair P2 are split by the mating conductors +4 and −5 of the differential pair P1. Near-end crosstalk (NEXT) may develop between the differential pairs P1 and P2 when the plug contacts 146 engage the select mating conductors 118 along the corresponding mating surfaces 120.

FIG. 4 is a schematic side view of the contact sub-assembly 110 when the modular plug 145 is engaged with the connector 100 (FIG. 1). (For illustrative purposes, the connector body 101 is not shown and a portion of the modular plug is exposed.) Each mating conductor 118 may extend along the mating direction A between a plug contact engagement portion 127 and the circuit contact portion 252 that electrically connects to the corresponding conductor vias 139. The engagement portion 127 includes the mating surface 120. The engagement portion 127 and the circuit contact portion 252 are separated by a length of the corresponding mating conductor 118. The band 133 and/or a transition region (discussed below) may be located between the engagement portion 127 and the circuit contact portion 252. The engagement portion 127 is configured to interface with the corresponding plug contact 146 along the mating surface 120, and the circuit contact portion 252 is configured to be electrically connected to the printed circuit 132. Although not shown, the circuit contact portion 252 may also be electrically connected to the compensation component 140 (FIG. 2).

The plug contacts 146 of the modular plug 145 are configured to selectively engage mating conductors 118 of the array 117. When the plug contacts 146 engage the mating conductors 118 at the corresponding mating surfaces 120, offending signals that cause noise/crosstalk may be generated. The offending crosstalk (NEXT loss) is created by adjacent or nearby conductors or contacts through capacitive and inductive coupling which yields the unwanted exchange of electromagnetic energy between a first differential pair and or signal conductor to second differential pair and or signal conductor.

Also shown, the circuit contact portions 252 may include end portions 149 that are mechanically engaged and electrically connected to corresponding shielded and conductor vias 151 and 139 of the printed circuit 132. The terminating portions 124 may include the terminal vias 141 electrically connected to corresponding terminal contacts 143. The shielded and conductor vias 151 and 139 are electrically connected to select terminal vias 141 through traces 147 of the printed circuit 132. Each terminal via 141 may be electrically connected to a terminal contact 143, which are illustrated as IDC's in FIG. 4. The terminal contacts 143 mechanically engage and electrically connect to corresponding wires 122. As such, the printed circuit 132 may interconnect the mating conductors 118 to the terminal contacts 143 and transmit signal current therethrough.

As will be discussed in greater detail below, the coupling regions 138 may be arranged and configured with respect to each other to improve the performance of the connector 100 (FIG. 1). Furthermore, the conductor vias 139, the shielded vias 151, and the terminal 141 may be arranged with respect to each other to improve the performance of the connector 100. In addition, the traces 147 of the printed circuit 132, the compensation component 140, and the arrangement of the mating conductors 118 may also be configured to improve the performance of the connector 100.

In the illustrated embodiment, the mating conductors 118 form at least one interconnection path, such as the interconnection path X1, that transmits signal current between the mating end 104 (FIG. 1) and the loading end 106 (FIG. 1). As an example, the interconnection path X1 may extend between the engagement portions 127 of the mating conductors 118 and the circuit contact portions 252 to the corresponding conductor and shielded vias 139 and 151. Although not indicated, another interconnection path may extend between the conductor and shielded vias 139 and 151, the PCB traces 147, the terminal vias 141, and to the terminal contacts 143. An "interconnection path," as used herein, is collectively formed by mating conductors and/or traces of a differential pair(s) that are configured to transmit a signal current between corresponding input and output terminals or nodes when the electrical connector is in operation. Along an interconnection path, the mating conductors and/or traces experience crosstalk coupling from each other that may be used for compensation to reduce or cancel the offending crosstalk and/or to improve the overall performance of the connector. In some embodiments, the signal current may be a broadband frequency signal current. By way of example, each differential pair P1-P4 (FIG. 3) transmits signal current along the interconnection path X1 between the corresponding engagement portion 127 and the corresponding circuit contact portion 252. Although not shown, in some embodiments, another interconnection path may extend through the compensation component 140 (FIG. 2). Such embodiments are described in greater detail in U.S. patent application Ser. No. 12/190,920, which is incorporated by reference in the entirety.

Techniques for providing compensation may be used along the interconnection path X1, such as reversing the polarity of crosstalk coupling between the conductors/traces and/or using discrete components. By way of an example, the band 133 of dielectric material may support the mating conductors 118 as the mating conductors 118 are crossed over each other at a transition region 135. In other embodiments, non-ohmic plates and discrete components, such as, resistors, capacitors, and/or inductors may be used along interconnection paths for providing compensation to reduce or cancel the offending crosstalk and/or to improve the overall performance of the connector. Also, the interconnection path X1 may include one or more NEXT stages. A "NEXT stage," as used herein, is a region where signal coupling (i.e., crosstalk coupling) exists between conductors or pairs of conductors of different differential pairs or signal paths and where the magnitude and phase of the crosstalk are substantially similar, without abrupt change. The NEXT stage could be a NEXT loss stage, where offending signals are generated, or a NEXT compensation stage, where NEXT compensation is provided. As shown in FIG. 4, the interconnection path X1 may include a NEXT loss Stage 0 and a NEXT compensation Stage I. The Stages 0 and I are separated by the transition region 135.

FIG. 5 is an elevation view of the printed circuit 132 as viewed from the loading end 106 (FIG. 1) and illustrating the terminal vias 141, the conductor vias 139, and the shielded vias 151 arranged with respect to each other in the exemplary embodiment. The printed circuit 132 includes the substrate 202 having a length $L_1$ that extends along a vertical or first orientation axis 190 and a width $W_1$ that extends along a horizontal or second orientation axis 192. The terms "horizontal" and "vertical" are used only for describing orientation and not intended to limit the embodiments described herein. The substrate 202 has a substantially rectangular and planar body and a surface $S_1$ extending therealong. The substrate 202 includes side edges 210-213. The side edges 211 and 213 extend substantially parallel to each other and extend widthwise along the second orientation axis 192. The side edges 210 and 212 extend substantially parallel to each other and extend lengthwise along the first orientation axis 190. Although the length $L_1$ is illustrated as being greater than the width $W_1$, in alternative embodiments, the width $W_1$ may be greater than the length $L_1$ or the length $L_1$ and width $W_1$ may be substantially equal. Also, although the substrate 202 is shown as being substantially rectangular, the substrate may have other geometric shapes that include curved or planar side edges.

The substrate 202 may be formed from a dielectric material (s) having multiple layers and include opposite end portions 204 and 206 and a center portion 208 extending therebetween. The substrate 202 is configured to interconnect the wires 122 (FIG. 1) and the mating conductors 118 (FIG. 1) so that current may flow therethrough. The conductor and shielded vias 139 and 151 are configured to electrically connect with corresponding mating conductors 118, and the terminal vias 141 are configured to electrically connect with the terminal contacts 143 (FIG. 4). Similar to the mating conductors 118 shown in FIG. 3, the conductor vias 139, the shielded vias 151, and the terminal vias 141 may form the differential pairs P1-P4 and may be referred to as conductor vias 1-8, shielded vias 1-8, or terminal vias 1-8. (In the exemplary embodiments, the shielded vias 151 are electrically connected to the mating conductors 118 of the differential pair P2.) Accordingly, the conductor vias 139, the shielded vias 151, and the terminal vias 141 are configured to transmit signal current of the differential pairs P1-P4 (FIG. 3).

The substrate 202 may include a circuit array 224 that includes the plurality of conductor vias 139, the pair of shielded vias 151, and the plurality of terminal vias 141 arranged with respect to each other to for mitigating offending crosstalk and/or improving return loss. The plurality of conductor vias 139 and the pair of shielded vias 151 may form an interior array 220 and the plurality of terminal vias 141 may form an outer ring 221 (shown in FIG. 6) having outer ring portions 222A and 222B. In the illustrated embodiment, the shielded vias 151 are the vias −3 and +6 associated with the differential pair P2 (i.e., the pair of shielded vias 151 are electrically connected to the mating conductors 118 of differential pair P2). The interior array 220 may also include first and second shielding rows 230 and 232 of conductor vias 139 that are located to isolate and shield the shielded vias 151 from the terminal vias 141. The first and second shielding rows 230 and 232 of conductor vias 139 are located between the end portions 204 and 206.

In the illustrated embodiment, the shielded vias −3 and +6 of the differential pair P2 may be centrally located in the circuit array 224. As used herein, the term "centrally located" includes the shielded vias −3 and +6 being located generally near a center 226 of the circuit array 224 (or the outer ring 221 shown in FIG. 6) and surrounded by the conductor vias 139 and terminal vias 141. The shielded vias 151 may be adjacent to one another. As used herein, two vias are "adjacent" to one another when the two vias are relatively close to each other and no other via is located therebetween. For example, with respect to FIG. 5, the shielded vias −3 and +6 of the differential pair P2 are adjacent; the terminal vias −3 and +6 of the differential pair P2 are adjacent; the terminal vias −5 and +4 of the differential pair P1 are adjacent; the terminal vias −7 and +8 of the differential pair P4 are adjacent; the terminal vias −1 and +2 of the differential pair P3 are adjacent. Furthermore, vias that are not of a differential pair may be adjacent. For example, the conductor via −5 is adjacent to the conductor via +2 and the conductor via +8. Furthermore, the conductor via +2 is adjacent to the terminal via +6, and the conductor via −7 is adjacent to the terminal via −1.

The first and second shielding rows 230 and 232 are configured to electrically isolate the shielded vias 151 from the outer ring 221 (shown in FIG. 6) of surrounding terminal vias 141. As such, the pair of shielded vias 151 is located between the first and second shielding rows 230 and 232. As shown, the conductor vias 139 of the first shielding row 230 are distributed widthwise (i.e., spaced apart from each other) along a first row axis 240. The first row axis 240 may extend substantially parallel to the second orientation axis 192. The conductor vias 139 of the first shielding row 230 are substantially aligned with respect to each other along the first row axis 240 such that the first row axis 240 intersects the corresponding conductor vias 139. As shown, the first row axis 240 intersects centers of the conductor vias 139; however, the conductor vias 139 may be substantially aligned with respect to each other provided that the first row axis 240 intersects at least a portion of the each conductor via 139 of the first shielding row 230. Also shown, the conductor vias 139 of the second shielding row 232 are distributed widthwise along a second row axis 242. The first and second row axes 240 and 242 may extend substantially parallel to each other and the second orientation axis 192. The conductor vias 139 of the second shielding row 232 are substantially aligned with respect to each other along the second row axis 242.

Also shown, each of the centrally located shielded vias 151 may be substantially equidistant from the first and second shielding rows 230 and 232. More specifically, the shielded vias −3 and +6 may be spaced apart from each other and located along a central-pair axis 244 that extends substantially parallel to the first and second row axes 240 and 242. A shortest distance $Z_1$ measured from the shielded via −3 to the first row axis 240 may be substantially equidistant to a shortest distance $Z_2$ measured from the shielded via −3 to the second row axis 242. In the illustrated embodiment, the distance $Z_1$ is slightly greater than the distance $Z_2$. Likewise, the shielded via +6 may be substantially equidistant from the first and second row axes 240 and 242.

Figure 6:
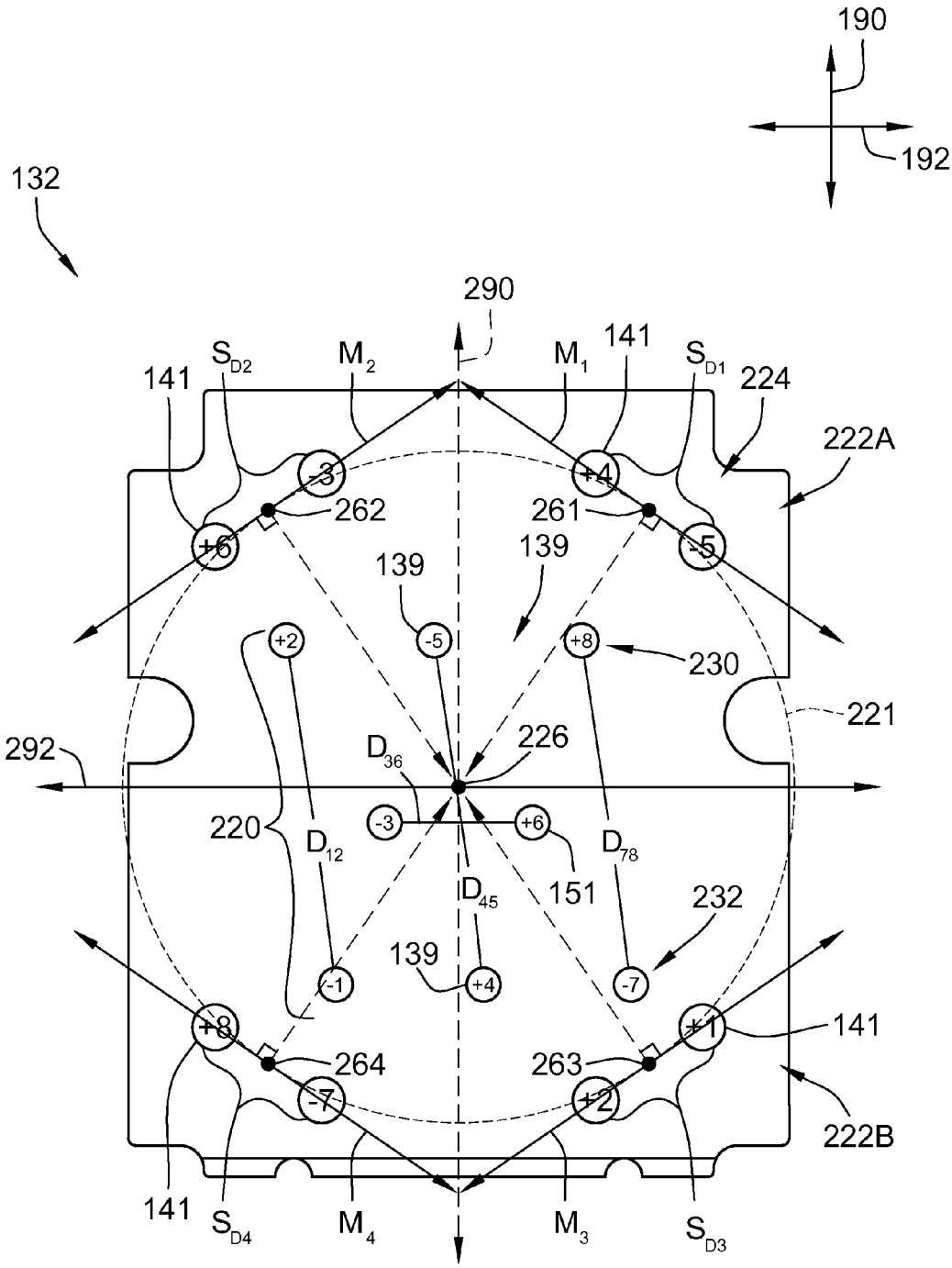
FIG. 6 is the elevation view of the printed circuit shown in FIG. 5 illustrating an arrangement of vias with respect to each other.

Each end portion 204 and 206 may include one of the outer ring portions 222A and 222B, respectively, which each include corresponding terminal vias 141 of the outer ring 221 (shown in FIG. 6). In the illustrated embodiments, each differential pair P1-P4 of terminal vias 141 (i.e., terminal vias −5 and +4; −3 and +6; −1 and +2; respectively) is located in a select or corresponding corner region $C_1$-$C_4$ of the substrate 202. The interior array 220 is located between the terminal vias 141 of the outer ring portions 222A and 222B.

As shown, the terminal vias 141 within each end portion 204 and 206 are distributed in a direction along the second orientation axis 192 (or in a direction along the first and second row axes 240 and 242). The terminal vias 141 may be spaced apart from each other in a direction along the second orientation axis 192 such that the terminal vias 141 may have more than two axial locations with respect to the second orientation axis 192 (i.e., the terminal vias 141 may be located on more than two axes that extend substantially parallel to the first orientation axis 190). FIG. 5 illustrates a particular embodiment where there are four axial locations 171-174. Specifically, the terminal vias +6 and +8 have a first axial location 171; the terminal vias −3 and −7 have a second axial location 172; the terminal vias +4 and +2 have a third axial location 173; and the terminal vias −5 and −1 have a fourth axial location 174. As such, each terminal via 141 within the end portion 204 has its own axial location with respect to the second orientation axis 192, and each terminal via 141 within the end portion 206 has its own axial location with respect to the second orientation axis 192. In other words, within each end portion 204 and 206, no two terminal vias 141 may be substantially aligned along an axis that extends substantially parallel to the first orientation axis 190.

However, in alternative embodiments, the terminal vias 141 may have only two or three axial locations. Furthermore, two terminal vias may be substantially aligned with respect to an axis that extends parallel to the first orientation axis 190 in other embodiments.

FIG. 6 is the elevation view of the printed circuit 132 from FIG. 5 and also illustrates the arrangement of the terminal vias 141, the shielded vias 151, and the conductor vias 139 in the circuit array 224. As shown, the substrate 202 may extend along center axes 290 and 292 that intersect the center 226 of the circuit array 224. (The center 226 of the circuit array 224 may or may not overlap a geometric center of the substrate 202.) The center axis 290 extends parallel to the first orientation axis 190, and the center axis 292 extends parallel to the second orientation axis 192. The terminal vias 141 may be arranged such that differential pairs P1-P4 of terminal vias 141 are symmetrical with respect to each other about the center axes 290 and 292.

Also, the terminal vias 141 of the differential pairs P1-P4 are arranged such that the terminal vias 141 of the differential pairs P1-P4 form the substantially circular-shaped outer ring 221 (indicated by a dashed outline). The outer ring 221 surrounds the interior array 220 of the conductor and shielded vias 139 and 151. Furthermore, each differential pair P1-P4 of terminal vias 141 may be located on a corresponding plane $M_1$-$M_4$, respectively. The planes $M_1$-$M_4$ may substantially face the interior array 220 (i.e., lines drawn perpendicular to the planes $M_1$-$M_4$ extend toward the interior array 220). Each plane $M_1$-$M_4$ may face a different direction with respect to the other planes $M_1$-$M_4$. Each plane $M_1$-$M_4$ may also face the center 226 or the centrally located shielded vias −3 and +6. More specifically, a line drawn from any point between associated terminal vias 141 along the respective plane $M_1$-$M_4$ to the center 226 may be substantially perpendicular to the respective plane $M_1$-$M_4$ (e.g., about 90°±10°). In alternative embodiments, only one, two, or three planes M face the center 226. In a more particular embodiment, at least two planes M (e.g., $M_1$ and $M_4$ or $M_2$ and $M_3$ in FIG. 6) may oppose each other (i.e., face each other) with the center 226 between the terminal vias 141. Also shown in FIG. 6, the planes $M_1$-$M_4$ may be equidistant from the center 226. However, in alternative embodiments, one or more planes M are not equidistant with respect to the other.

The associated terminal vias 141 of each differential pair P1-P4 may be adjacent to each other and separated from each other by a separation distance $S_D$. In the illustrated embodiment, the separation distances $S_{D1}$-$S_{D4}$ of the differential pairs P1-P4, respectively, are substantially equal. However, in alternative embodiments, the separation distances $S_{D1}$-$S_{D4}$ are not substantially equal. Furthermore, each separation distance $S_{D1}$-$S_{D4}$ may have a midpoint 261-264 between the associated terminal vias 141 and located on the respective plane $M_1$-$M_4$. Each plane $M_1$-$M_4$ may be tangent to the outer ring 221 at the corresponding midpoint 261-264, respectively. As shown in FIG. 6, lines drawn from the midpoints 261-264 may be substantially perpendicular to the center 226.

Furthermore, in some embodiments, the terminal vias 141 of one differential pair may be substantially equidistant from one of the conductor vias 139 of the first or second shielding row 230 and 232. For example, the conductor via −1 of the shielding row 232 may be substantially equidistant from the terminal vias +8 and −7 of the differential pair P4.

FIG. 5 shows that each conductor via 139 of the first and second shielding rows 230 and 232 may be separated from the shielded vias −3 and +6 by predetermined distances $D_{via\text{-}to\text{-}via}$. (The distances $D_{via\text{-}to\text{-}via}$ are measured from a center of one via to a center of the other via.) FIG. 6 shows that the associated conductor vias 139 of each differential pair P1-P4 may be separated from each other by predetermined distances $D_{via\text{-}to\text{-}via}$. Table 1 lists the respective distances $D_{via\text{-}to\text{-}via}$ for the particular embodiment shown in FIGS. 5 and 6.

TABLE 1

Distance ($D_{via\text{-}to\text{-}via}$) from conductor via to conductor via (mm) as shown in FIGS. 5 and 6

| | | | |
|---|---|---|---|
| $D_{25}$ | 3.048 | $D_{46}$ | 3.335 |
| $D_{58}$ | 3.048 | $D_{67}$ | 3.770 |
| $D_{23}$ | 4.155 | $D_{14}$ | 3.048 |
| $D_{35}$ | 3.764 | $D_{47}$ | 3.048 |
| $D_{56}$ | 4.155 | $D_{12}$ | 6.876 |
| $D_{68}$ | 3.764 | $D_{45}$ | 6.876 |
| $D_{13}$ | 3.335 | $D_{78}$ | 6.876 |
| $D_{34}$ | 3.770 | $D_{36}$ | 3.048 |

As shown in FIG. 5, the conductor vias +2, −5, and +8 of the first shielding row 230 may be evenly spaced apart from each other along the first row axis 240. The conductor vias −1, +4, and −7 of the second shielding row 232 may be evenly spaced apart from each other along the second row axis 242. The distances $D_{via\text{-}to\text{-}via}$ extending from the conductor vias 139 of the first shielding row 230 to the centrally located shielded vias −3 and +6 may be substantially equal (i.e., within approximately 30% of each other or, in a more specific embodiment, 20%). Furthermore, the distances $D_{via\text{-}to\text{-}via}$ extending from the conductor vias 139 of the second shielding row 232 to the centrally located shielded vias −3 and +6 may be substantially equal (i.e., within approximately 30% of each other or, in a more specific embodiment, 20%). In addition, the distance $D_{36}$ (FIG. 6) separating the shielded vias −3 and +6 may be approximately equal to the distances separating the conductor vias 139 along each shielding row. The distance $D_{36}$ also extends along the central-pair axis 244. Accordingly, the distance or length of the first shielding row 230 (i.e., $D_{25}+D_{58}$) is greater than the distance $D_{36}$ (FIG. 6) separating the shielded vias −3 and +6. Likewise, the distance or length of the second shielding row 232 (i.e., $D_{14}+D_{47}$) is greater than the distance $D_{36}$. Furthermore, the distance $D_{36}$ may be less than the shortest distances $Z_1$ and $Z_2$.

Also, the distance $D_{via\text{-}to\text{-}via}$ that separates the associated conductor vias 139 of one differential pair P1, P3, and P4 (i.e., $D_{45}$, $D_{12}$, $D_{78}$) in the interior array 220 may be substantially equal (e.g., the distance $D_{via\text{-}to\text{-}via}$ separating the conductor vias 139 of the differential pairs P1, P3, and P4 is equal to 6.876 mm in Table 1). The distance $D_{via\text{-}to\text{-}via}$ that separates the associated conductor vias 139 of a differential pair may also be used to determine the differential characteristic impedance between the associated conductor vias 139. The differential characteristic impedance of the conductor vias 139 may be determined by the radius of the conductor vias 139 and the $D_{via\text{-}to\text{-}via}$ between the associated mating conductors 118.

Also shown in FIG. 5, at least one of the shielded vias 151 may form a "dual-polarity" coupling with two conductor vias 139. In a dual-polarity coupling, the respective shielded via 151 electromagnetically couples with two conductor vias 139. For example, the respective shielded via 151 may electromagnetically couple with two conductor vias 139 in which the two conductor vias 139 have opposite signs with respect to each other. Dual-polarity coupling may facilitate in the reduction of offending crosstalk coupling that may occur between the conductor vias 139, shielded vias 151, and the terminal vias 141 in the printed circuit 132. In particular embodiments, the shielded via 151 may electromagnetically couple with two conductor vias 139 of the same differential pair. For example, the shielded via −3 is electromagnetically coupled with the conductor via +2, which has an opposite sign polarity, and is also electromagnetically coupled with the conductor −1, which has the same sign polarity. Furthermore, the shielded via +6 is electromagnetically coupled with the conductor via +8, which has the same sign polarity, and is also electromagnetically coupled with the conductor −7, which has the opposite sign polarity. In the illustrated embodiment, the conductor vias 139 that form a dual-polarity coupling are equivalent in size (i.e., they have a common diameter).

Accordingly, in some embodiments, the shielded via 151 may form a dual-polarity coupling with conductor vias 139 of a differential pair in which each shielding row 230 and 232 has one of the conductor vias 139 of the corresponding differential pair.

Furthermore, in some embodiments, the distance separating the electrically isolated shielded via 151 from the corresponding two dual-polarity conductor vias 139 may be substantially equidistant. For instance, first and second conductor vias +2 and −1 of the differential pair P3 may be located first and second distances away (i.e., distances $D_{13}$ and $D_{23}$), respectively, from the shielded via −3. A difference between the first and second distances may be at most 30% of one of the first and second distances. In a particular embodiment, the difference between the first and second distances may be at most 20% of one of the first and second distances. As another example, distance $D_{68}$ may be substantially equal to distance $D_{67}$. Accordingly, the electromagnetic coupling between the shielded via −3 and the conductor vias +2 and −1 may be substantially balanced, and the electromagnetic coupling between the shielded via +6 and the conductor vias +8 and −7 may be substantially balanced.

In addition to each shielded via −3 and +6 forming a dual-polarity coupling with a select one differential pair, each shielded via −3 and +6 may be electromagnetically coupled to another differential pair. For example, both of the shielded vias −3 and +6 may be electromagnetically coupled to the conductor vias −5 and +4 of the differential pair P 1. As such, the shielded vias −3 and +6 may each form a dual-polarity coupling with the conductor vias −5 and +4. Accordingly, the first and second rows 230 and 232 may not only electrically isolate the shielded vias −3 and +6 from the terminal vias 141, but may also electromagnetically couple in a balanced manner to the shielded vias −3 and +6.

Figure 7:
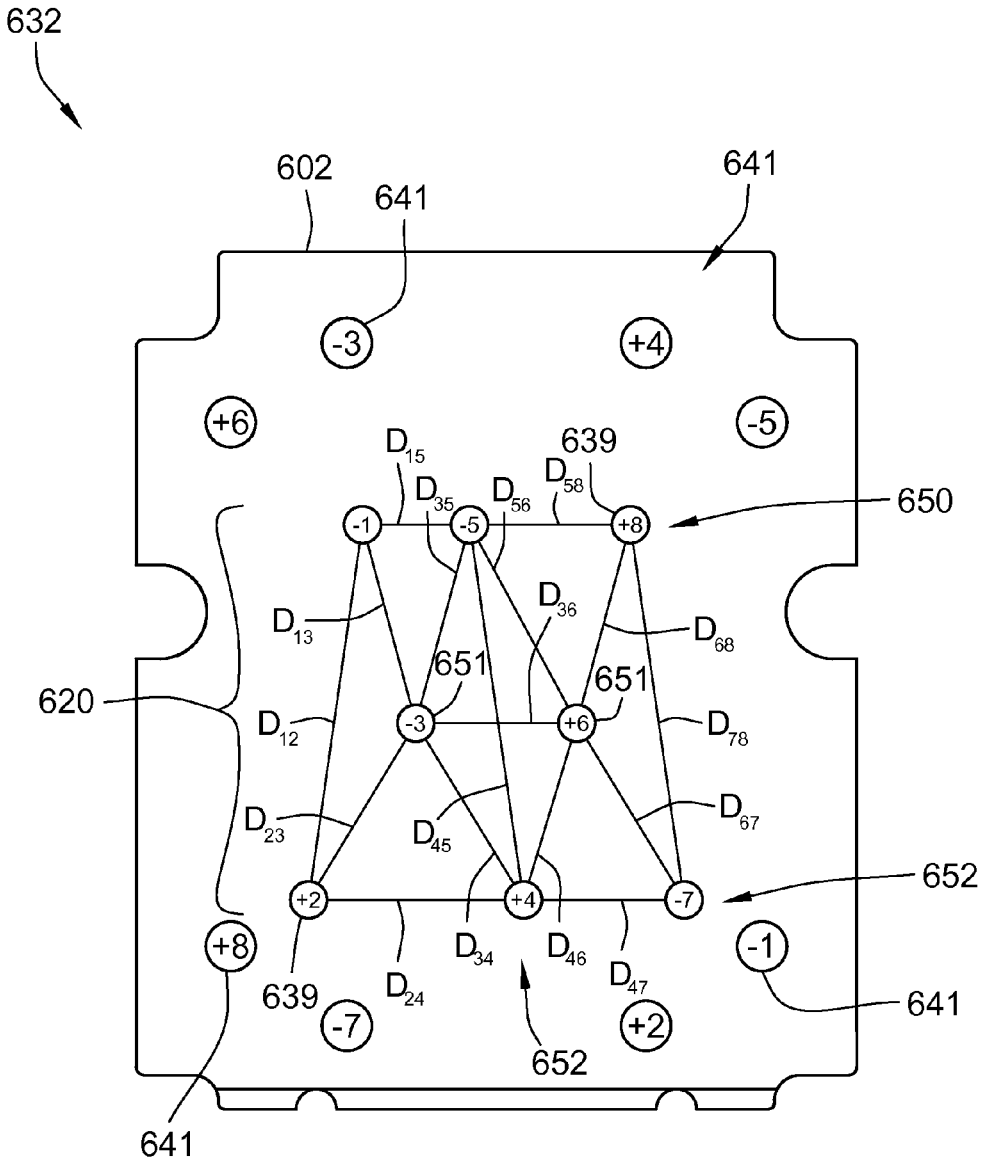
FIG. 7 is an elevation view of a printed circuit formed in accordance with another embodiment that may be used with the connector of FIG. 1.

FIG. 7 is an elevation view of a printed circuit 632 formed in accordance with an alternative embodiment that may be used with the connector 100 of FIG. 1. The printed circuit 632 may have similar features as the printed circuit 132 shown in FIGS. 5 and 6. For example, the printed circuit 632 may have a substrate 602 that is similar to the substrate 202 (FIG. 5). Furthermore, the substrate 602 may have terminal vias 641 that are similarly arranged as the terminal vias 141 (FIG. 5). However, the printed circuit 632 may include an interior array 620 of conductor vias 639 and shielded vias 651 that is different than the interior array 220 (FIG. 5) of the printed circuit 132.

The conductor vias 639 and the shielded vias 651 may be electrically connected to the mating conductors 118 (FIG. 1), which form the differential pairs P1-P4 (FIG. 3). The conductor vias 639 may form first and second shielding rows 650 and 652. The conductor vias 639 of each shielding row 650 and 652 may be substantially aligned with respect to each other. However, the conductor vias 639 of the differential pair P3 may be switched with respect to the conductor vias 139 (FIG. 5) of the differential pair P3. More specifically, the conductor via −1 is substantially aligned with the conductor vias −5 and +8 in the first shielding row 650, and the conductor via +2 is substantially aligned with the conductor vias +4 and −7 in the second shielding row 652. Furthermore, the conductor vias 639 of each shielding row 650 and 652 are not evenly spaced apart from each other as the conductor vias 139 are in first and second shielding rows 230 and 232 (FIG. 5). In a particular embodiment, the interior array 620 of conductor vias 639 and shielded vias 651 may be separated by distances $D_{via\text{-}to\text{-}via}$ as listed in Table 2.

TABLE 2

| Distance ($D_{via\text{-}to\text{-}via}$) from conductor via to conductor via (mm) as shown in FIG. 7 | | | |
|---|---|---|---|
| $D_{15}$ | 2.032 | $D_{46}$ | 3.335 |
| $D_{58}$ | 3.048 | $D_{67}$ | 3.770 |
| $D_{23}$ | 3.770 | $D_{24}$ | 4.064 |
| $D_{35}$ | 3.764 | $D_{47}$ | 3.048 |
| $D_{56}$ | 4.155 | $D_{12}$ | 6.876 |
| $D_{68}$ | 3.764 | $D_{45}$ | 6.876 |
| $D_{13}$ | 3.764 | $D_{78}$ | 6.876 |
| $D_{34}$ | 3.770 | $D_{36}$ | 3.048 |

Similar to the first and second shielding rows 230 and 232 of FIGS. 5 and 6, the first and second shielding rows 650 and 652 of conductor vias 639 may be configured to electrically isolate the centrally located shielded vias 651 from the terminal vias 641. Furthermore, each shielded via −3 and +6 may form a dual-polarity coupling with the conductor vias 639 of the first and second shielding rows 650 and 652. As shown, each shielded vias 651 may be electromagnetically coupled to the conductor vias 639 of one differential pair. More specifically, the shielded via −3 is electromagnetically coupled with the conductor vias +2 and −1 (i.e., the conductor vias 139 of the differential pair P3), and the shielded via +6 is electromagnetically coupled with the conductor vias +8 and −7 (i.e., the conductor vias 139 of the differential pair P4). In the illustrated embodiment, the distance $D_{via\text{-}to\text{-}via}$ separating the shielded via −3 from conductor vias −1 and +2 may be substantially equal, and the distance $D_{via\text{-}to\text{-}via}$ separating the shielded via +6 from conductor vias +8 and −7 may be substantially equal. The electromagnetic coupling among the conductor vias 639 may be configured as desired.

Although FIGS. 5-7 illustrate particular embodiments for electrically isolating the shielded vias of the differential pair P2 and/or for forming a dual-polarity coupling with the conductor vias of the shielding rows, other embodiments having different configurations, dimensions, and distances $D_{via\text{-}to\text{-}via}$ may be made.

Figure 8A:
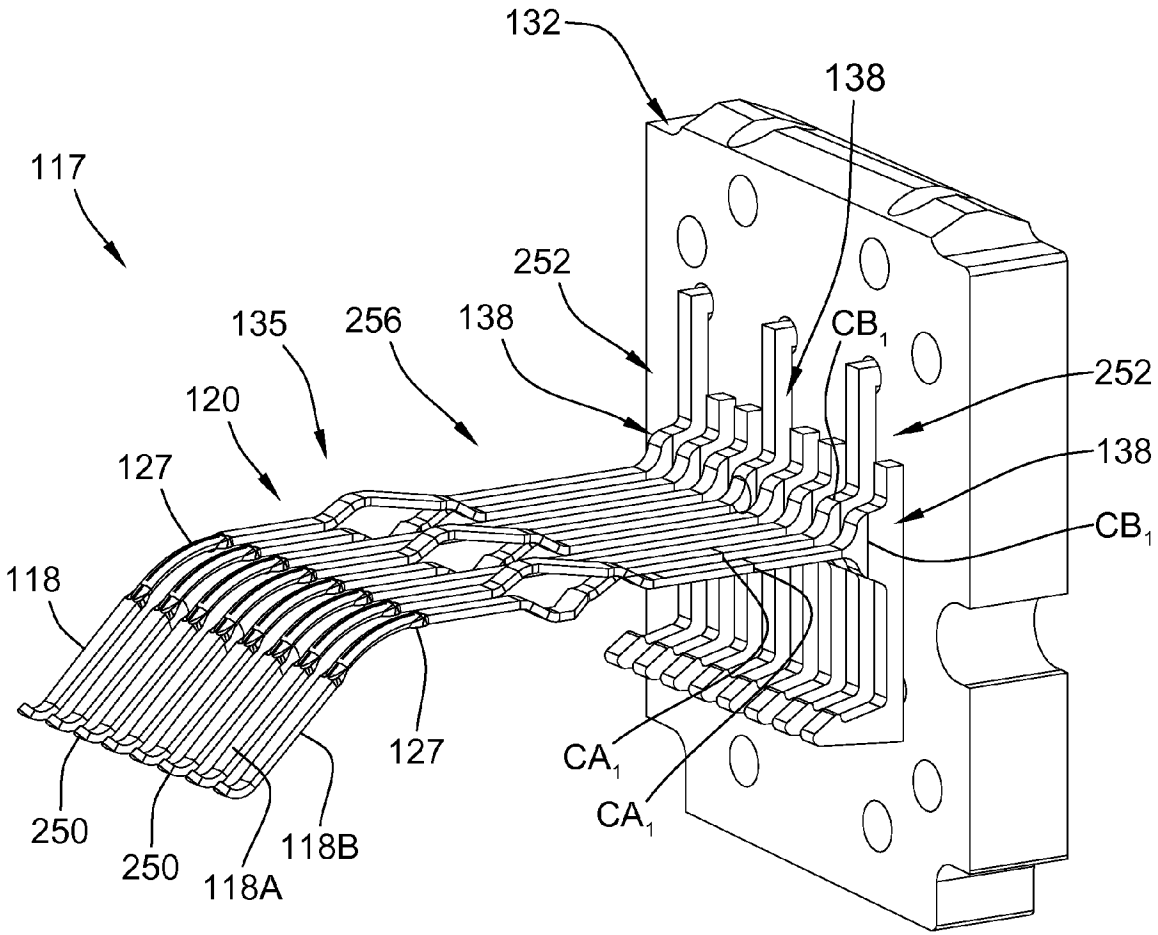
FIG. 8A is a perspective view of the printed circuit and an array of mating conductors that may be used with the connector of FIG. 1.

FIG. 8A is an exposed perspective view of the printed circuit 132 and the array 117 of mating conductors 118 of the contact sub-assembly 110 (FIG. 1). The mating conductors 118 may extend from distal tips 250 that are configured to engage the contact pads 144 (FIG. 2) and extend toward the printed circuit 132. As shown, each mating conductor 118 may extend from a corresponding distal tip 250 through the plug contact engagement portion 127. The mating conductor 118 may then extend through the transition region 135 where the mating conductor 118, optionally, may be switched or cross-over another mating conductor. From there, the mating conductor 118 may extend to a bridge portion 256 and then to the circuit contact portion 252 that mechanically and electrically engages the printed circuit 132. As will be described in greater detail, when the mating conductor 118 extends from the engagement portion 127 toward the printed circuit 132, the mating conductor 118 may form or shape into the coupling region 138. More specifically, the bridge portions 256 and/or the circuit contact portions 252 may include the coupling regions 138.

Figure 8B:
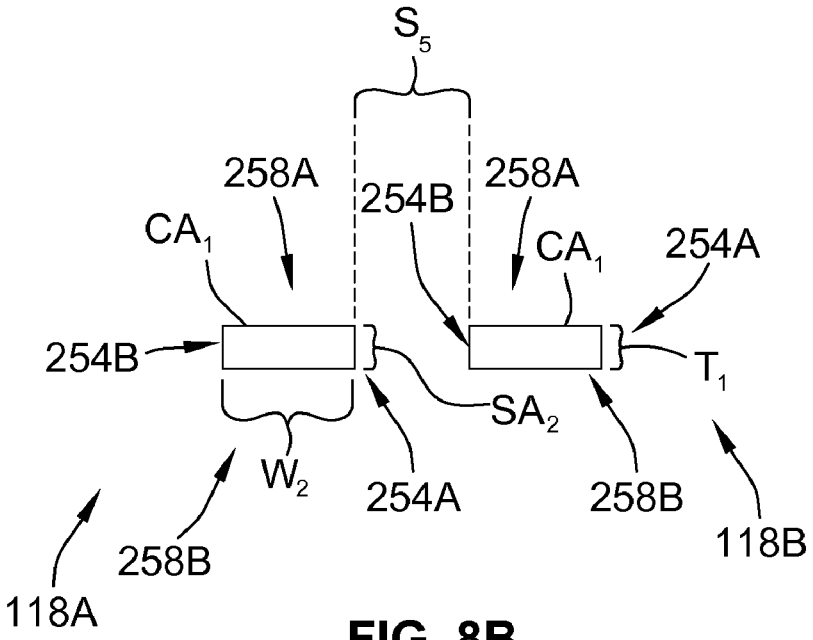
FIG. 8B is a cross-sectional view of bridge portions of adjacent mating conductors of FIG. 8A.
Figure 8C:
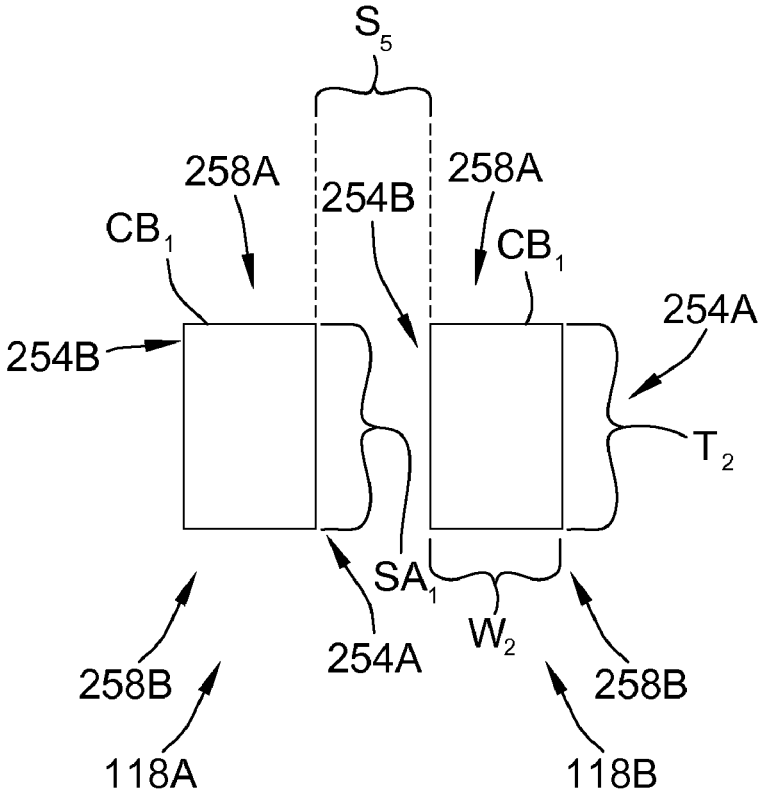
FIG. 8C is a cross-sectional view of coupling regions of adjacent mating conductors of FIG. 8A.

FIGS. 8B and 8C show cross-sections $CA_1$ and $CB_1$ of two adjacent mating conductors 118A and 118B. FIG. 8B illustrates cross-sections $CA_1$ taken with the corresponding bridge portions 256 (FIG. 8A) of the adjacent mating conductors 118A and 118B. FIG. 8C illustrates cross-sections $CB_1$ taken with coupling regions 138 (FIG. 8A) of the adjacent mating conductors 118A and 118B. In FIG. 8A, the coupling regions 138 are shown as being within the circuit contact portions 252. However, in alternative embodiments, the coupling regions 138 may be in other portions of the mating conductors 118, such as the bridge portion.

As shown in FIG. 8C, the coupling region 138 of a mating conductor 118 may have an increased surface area $SA_1$ along a side 254A with respect to other portions of the mating conductor 118 (e.g., with respect to the engagement portion 127, distal tip 250). As one example shown in FIG. 8B, the coupling region 138 may have an increased surface area $SA_1$ with respect to a surface area $SA_2$ of the bridge portion 256. In FIGS. 8-10, the surface area SA of the coupling regions appears to be indicated as one dimension in the cross-sections. However, those skilled in the art understand that a surface area SA of a planar surface is the product of two dimensions and that the other dimension of the coupling regions that is not shown in the cross-sections of FIGS. 8-10 is a length in which the adjacent mating conductors extend alongside each other in the coupling regions.

The coupling regions 138 of adjacent mating conductors 118A and 118B may increase the capacitive coupling between the adjacent mating conductors 118A and 118B thereby affecting the crosstalk coupling of the connector 100. In some embodiments, the surface area SA of each coupling region 138 may be configured to create desired compensatory crosstalk that may reduce or cancel the offending crosstalk coupling that occurs at the plug contacts 146 and/or mating surfaces 120 of the engagement portions 127. In a more particular embodiment, the surface area SA of each coupling region 138 may be approximately equal to surface areas of the plug contacts 146 (FIG. 4) that face each other when the modular plug 145 (FIG. 4) engages the connector 100.

Returning to FIGS. 8B and 8C, the mating conductors 118A and 118B are adjacent to one another and extend alongside each other. As shown, the mating conductors 118A and 118B have a spacing $S_5$ therebetween. In alternative embodiments, the spacing $S_5$ may vary as desired as varying the spacing $S_5$ may affect the electromagnetic coupling of the adjacent mating conductors 118A and 118B. However, in the illustrated embodiment, the spacing $S_5$ is uniform from the transition region 135 to the printed circuit 132. Furthermore, each mating conductor 118 has opposite sides 254A and 254B and opposite edges 258A and 258B. The side 254A of one mating conductor 118 may face the side 254B of another mating conductor 118.

The mating conductors 118A and 118B may have a uniform width $W_2$ at the cross-sections $CA_1$ and $CB_1$. The mating conductors 118A and 118B may have a thickness $T_1$ (FIG. 8B) at the cross-section $CA_1$ and a thickness $T_2$ (FIG. 8C) at the cross-section $CB_1$. In some embodiments, the thickness $T_2$ is greater along the coupling region 138 than the thickness $T_1$ at the bridge portion 256. The thickness $T_1$ may be less than the width $W_2$ at the bridge portion 256, but the thickness $T_2$ may be greater than the width $W_2$ at the coupling region 138 (and also greater than the thickness $T_1$ in the bridge portion 256). Accordingly, in the exemplary embodiment, a surface area $SA_1$ along the sides 254 of the cross-section $CB_1$ is greater than a surface area $SA_2$ along the sides 254 of the cross-section $CA_1$. The surface areas $SA_1$ may be sized and shaped for a desired amount of crosstalk coupling. For example, the greater the surface area $SA_1$, the greater an amount of crosstalk coupling may be generated.

Figure 9A:
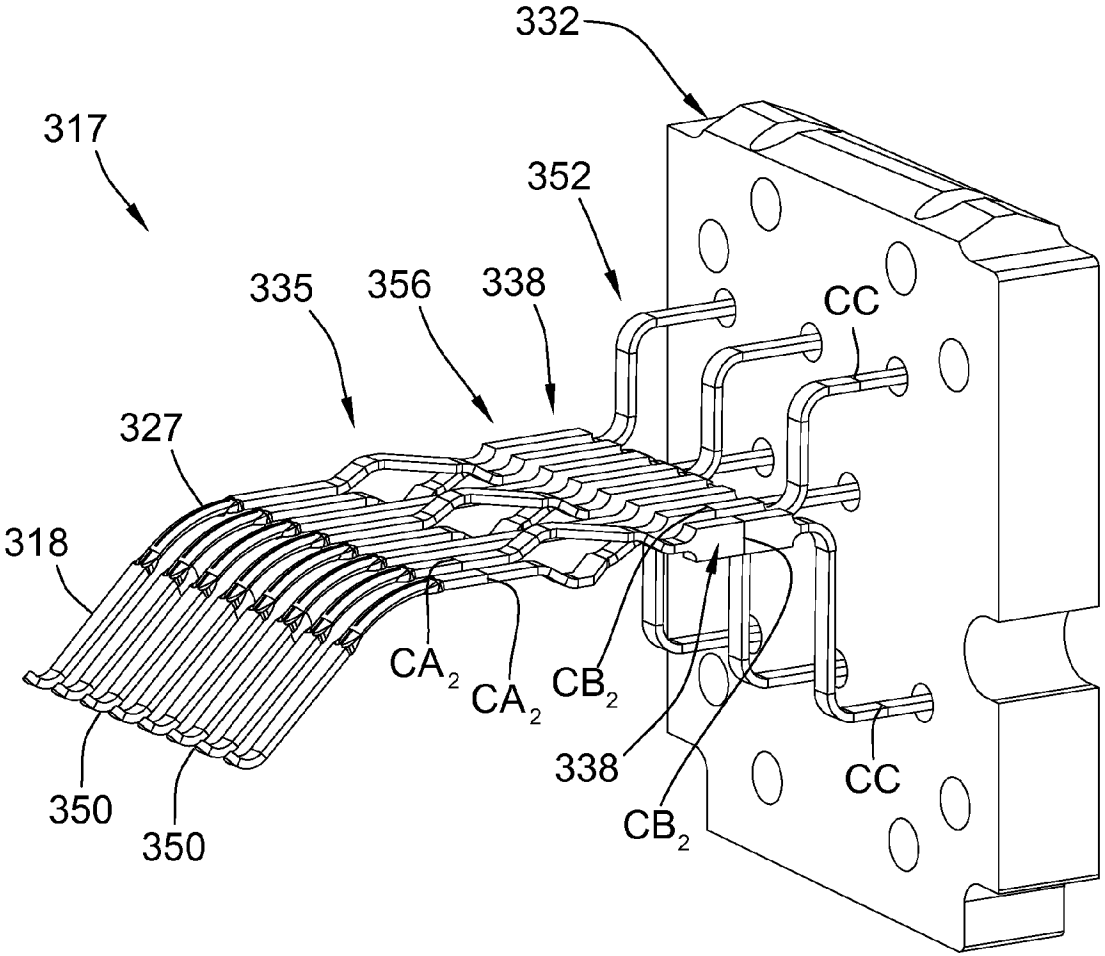
FIG. 9A is a perspective view of a printed circuit and an array of mating conductors in accordance with another embodiment.
Figure 9B:
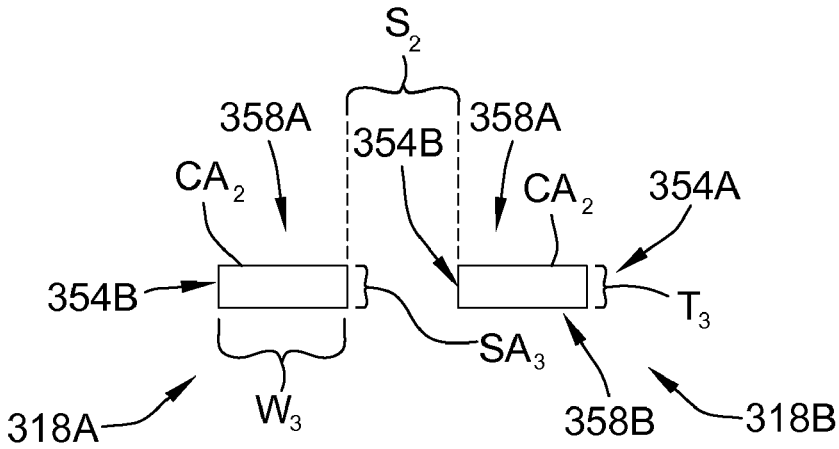
FIG. 9B is a cross-sectional view of engagement portions of the adjacent mating conductors of FIG. 9A.
Figure 9C:
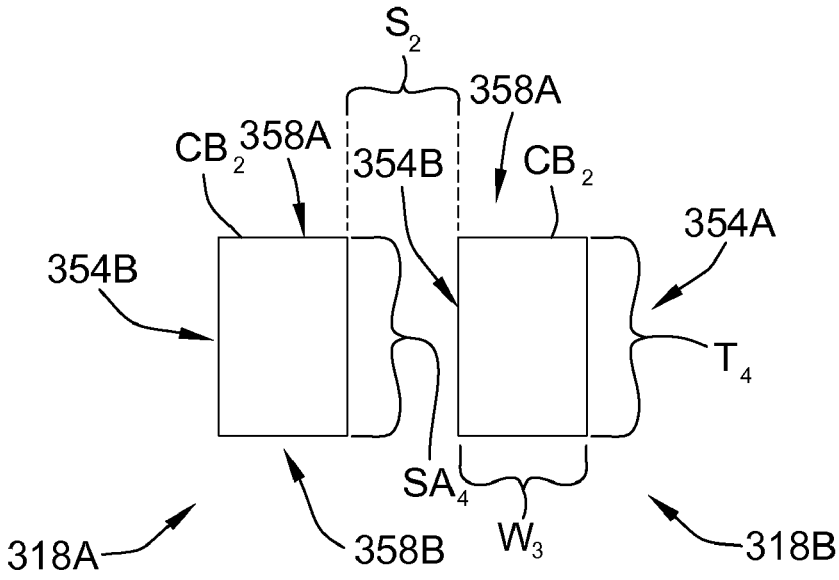
FIG. 9C is a cross-sectional view of coupling regions of the adjacent mating conductors of FIG. 9A.
Figure 9D:
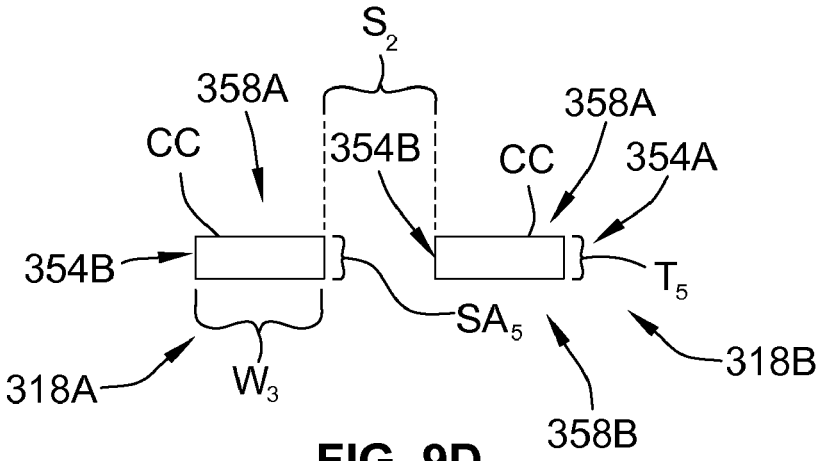
FIG. 9D is a cross-sectional view of circuit contact portions of the adjacent mating conductors of FIG. 9A.
Figure 10:
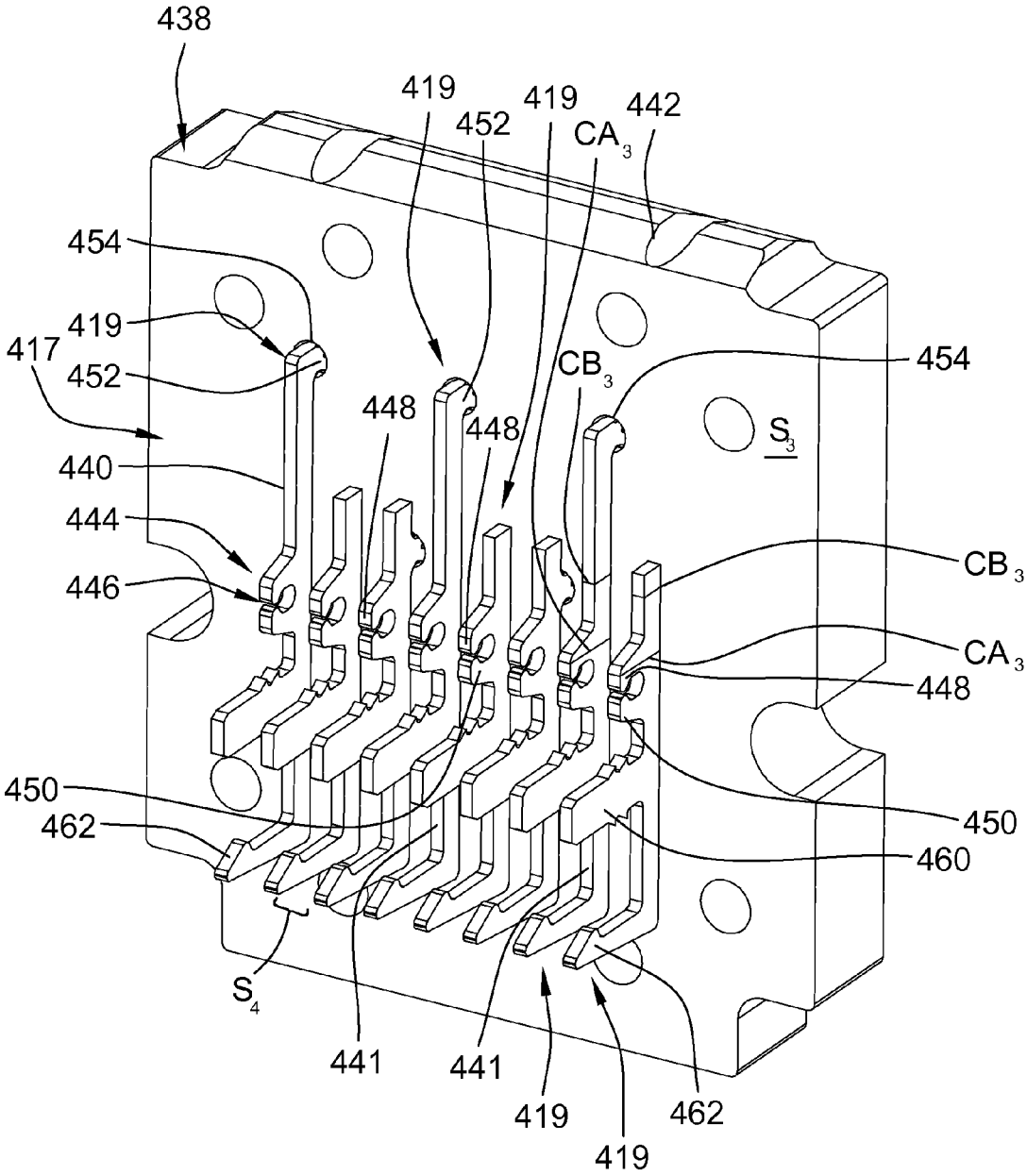
FIG. 10 is a perspective view of a printed circuit and an array of circuit contacts in accordance with another embodiment.

FIG. 9A is an exposed perspective view of a printed circuit 332 and an array 317 of mating conductors 318 of a contact sub-assembly (not shown) formed in accordance with another embodiment. The contact sub-assembly may be incorporated into an electrical connector, such as the connector 100 (FIG. 1). Each mating conductor 318 may extend from a corresponding distal tip 350 through a plug contact engagement portion 327 to a transition region 335 of the array 317. Each mating conductor 318 may then extend to a bridge portion 356 and then to a circuit contact portion 352 that mechanically and electrically engages the printed circuit 332. As shown in FIG. 9A, the bridge portions 356 may include the coupling regions 338. FIGS. 9B, 9C, and 9D show cross-sections $CA_2$, $CB_2$, and CC, respectively, of two adjacent mating conductors 318A and 318B. Specifically, FIG. 9B illustrates cross-sections $CA_2$ taken within the corresponding engagement portions 327 (FIG. 9A); FIG. 9C illustrates cross-sections $CB_2$ taken within coupling regions 338 in the bridge portions 356 (FIG. 9A); and FIG. 9D illustrates cross-sections CC taken with the circuit contact portions 352 (FIG. 9A) that engage the printed circuit 332 (FIG. 9A).

As shown in FIG. 9A-9D, the mating conductors 318A and 318B are adjacent to one another and extend alongside each other. The mating conductors 318A and 318B have a uniform spacing $S_2$ therebetween (FIGS. 9B-9D). As shown in FIGS. 9B-9D, each mating conductor 318 has opposite sides 354A and 354B and opposite edges 358A and 358B. The side 354A of one mating conductor 318 may face the side 354B of another mating conductor 318. The mating conductors 318 may have a uniform width $W_3$ at the engagement portion 327 (FIG. 9B), the coupling region 338 (FIG. 9C), and the circuit contact portion 352 (FIG. 9D). The mating conductors 318 may have a thickness $T_3$ (FIG. 9B) at the engagement portion 327, a thickness $T_4$ (FIG. 9C) at the coupling region 338 (or bridge portion 356), and a thickness $T_5$ (FIG. 9D) at the circuit contact portion 352. The thickness $T_4$ is greater along the coupling region 338 than the thicknesses $T_3$ and $T_5$. As shown, the thickness $T_3$ is less than the width $W_3$ at the engagement portion 327, and the thickness $T_5$ is less than the width $W_3$ at the circuit contact portion 352. However, the thickness $T_4$ is greater than the width $W_3$ at the bridge portion 356.

Similar to the coupling regions 138 (FIG. 8A), the coupling regions 338 of the mating conductors 318 may have an increased surface area SA along the sides 354 with respect to other portions of the mating conductor 318. For example, a surface area $SA_4$ along the sides 354 of the bridge portions 356 is greater than a surface area $SA_3$ along the sides 354 of the bridge portions 356 and greater than a surface area $SA_5$ along the sides 354 of the circuit contact portions 352. The surface area $SA_4$ may be sized and shaped for a desired amount of crosstalk coupling. As such, the coupling regions 338 may be positioned a distance away or spaced apart from the printed circuit 332.

FIG. 10 is a perspective view of a printed circuit 438 and an array 417 of circuit contacts 419 that are mechanically and electrically engaged to the printed circuit 438. The printed circuit 438 and the array 417 may be components of a contact sub-assembly (not shown) that may be incorporated into an electrical connector, such as the connector 100 (FIG. 1). The circuit contacts 419 may be separate or discrete with respect to mating contacts (not shown) that electrically and mechanically engage the circuit contacts 419. As used herein, the term "mating conductor" includes unitary mating conductors, such as the mating conductors 118 (FIGS. 8A-8C) and 318 (FIGS. 9A-9D), as well as mating conductors that are formed by separate circuit contacts 419 and mating contacts that are mechanically and electrically engaged to each other. Such embodiments that include circuit contacts 419 are described in greater detail in U.S. patent application Ser. No. 12/547,321, filed contemporaneously herewith and incorporated by reference in the entirety.

As shown in FIG. 10, each circuit contact 419 may have a beam 440 or 441 that extends along a surface $S_3$ of a substrate 442 of the printed circuit 438. The beams 440 and 441 extend directly alongside the surface $S_3$. Each circuit contact 419 may include a mating contact engagement portion 444 having a slot 446 defined by opposing arms 448 and 450. The engagement portion 444 extends away from the surface $S_3$ toward a mating end (not shown) of the connector. The engagement portion 444 is configured to receive and hold an end of a corresponding mating contact (not shown) within the slot 446 to electrically and mechanically engage the circuit contact 419 to the mating contact. Furthermore, each circuit contact 419 includes an end portion 452 that is inserted into a conductor via 454 of the substrate 442. The end portion 452 may be, for example, an eye-of-needle type pin that mechanically and electrically engages the corresponding circuit contact 419 to the printed circuit 438. Optionally, each circuit contact 419 may include an extension 460 and a gripping element 462 that extend away from the surface $S_3$ toward the mating end. The extension 460 and the gripping element 462 may be spaced apart from each other so that a thickness of a circuit board (not shown) may be held therebetween. In some embodiments, the gripping element 462 may be configured to engage contact pads on an underside of the circuit board. The extension 460 may be configured to engage other components of the connector. Such embodiments are described in U.S. patent application Ser. Nos. 12/547,321 and 12/547,245, which are incorporated by reference in the entirety. Furthermore, the extensions 460 and gripping elements 462 of adjacent circuit contacts 419 may be configured to capacitively couple to each other to generate crosstalk coupling.

The circuit contacts 419 of the array 417 may extend parallel to and be spaced apart from each other. More specifically, two adjacent circuit contacts 419 may be separated from each other by a uniform spacing $S_4$. In FIG. 10, the circuit contacts 419 are evenly distributed or spaced apart from each other along the surface $S_3$ of the substrate 442. However, in alternative embodiments, the circuit contacts 419 may not be evenly distributed. The circuit contacts 419 may also extend parallel to the surface $S_3$.

Similar to the mating conductors 118 and 318, the circuit contacts 419 may include coupling regions that are configured to electromagnetically couple to coupling regions on other circuit contacts 419. In the exemplary embodiment, an entirety of the circuit contact 419 may be considered a coupling region since the circuit contacts 419 may have greater dimensions than the mating contacts. More specifically, sides of the circuit contacts 419 that face each other may have a greater surface area than sides of the mating contacts that face each other in the interior chamber (not shown). Furthermore, in some embodiments, the circuit contacts 419 may have varying cross-sections therealong to generate a desired crosstalk coupling similar to the embodiments described above. For example, the circuit contacts 419 may have cross-sections $CB_3$ and $CA_3$ as shown in FIG. 10 in which the circuit contacts 419 at the cross-sections $CA_3$ have a greater surface area than a surface area of the circuit contacts 419 at the cross-sections $CB_3$.

Figure 11:
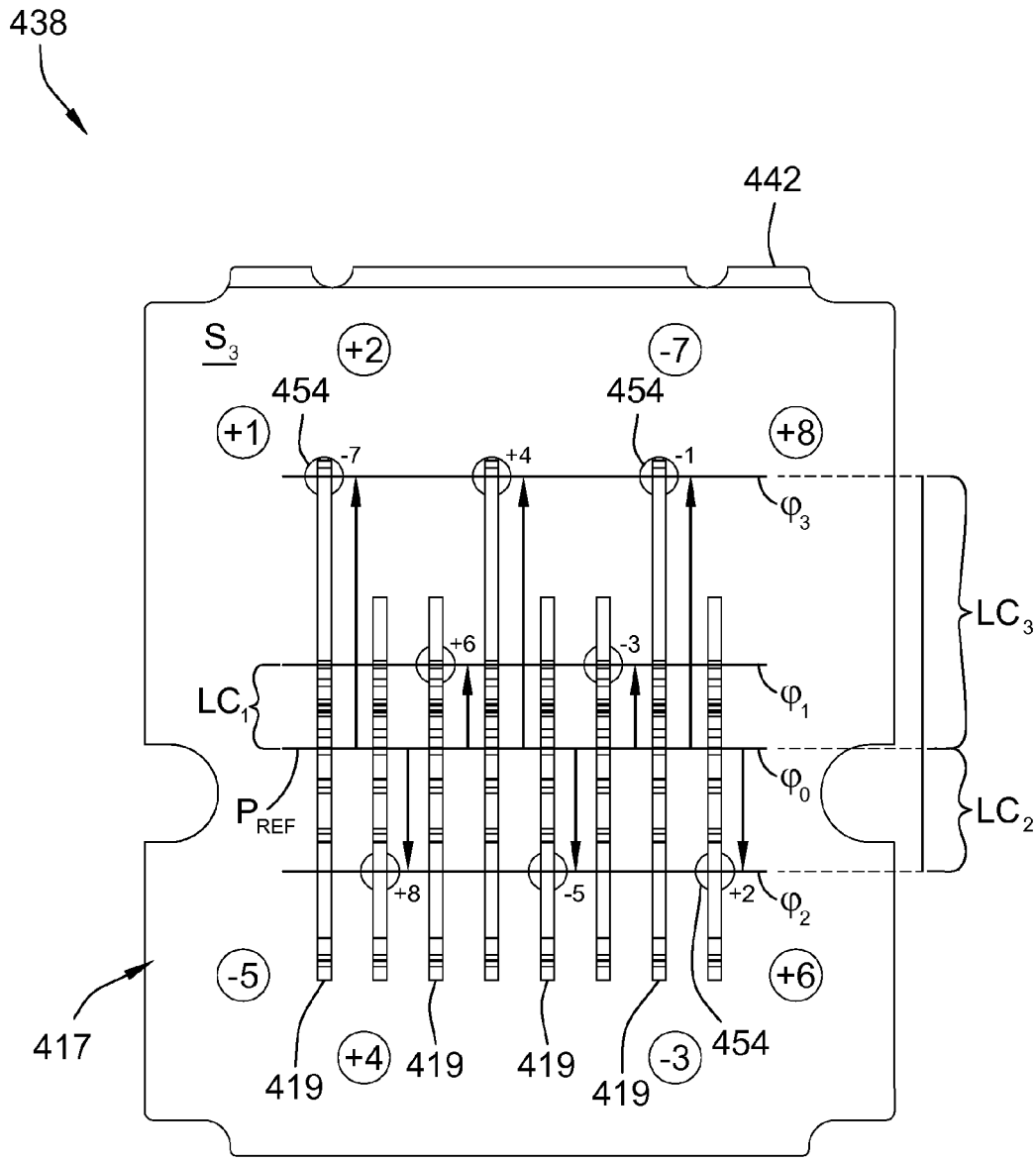
FIG. 11 is an elevation view of the printed circuit and the array of circuit contacts shown in FIG. 10.

FIG. 11 is a front elevation view of the circuit contacts 419 extending alongside the surface $S_3$ of the printed circuit 438. The printed circuit 438 may have the same configuration of vias as the printed circuit 132 shown in FIGS. 5 and 6. Although the following description is with specific reference to the circuit contacts 419, the circuit contact portions 252 and 352 may have similar features.

In some embodiments, a time delay between adjacent circuit contacts 419 (or circuit contact portions) may be formed to create a phase imbalance and to improve the electrical performance of the connector 100 (FIG. 1). For example, the imbalance may be used to improve return loss and/or generate a desired amount of crosstalk coupling. As current is transmitted through a connector that includes the array 417 of circuit contacts 419, the differential signals of the differential pairs P1-P4 (FIG. 3) may be phase matched $\phi_0$ at a location where a reference plane $P_{REF}$ intersects each circuit contact 419. Each circuit contact 419 forms an interconnection path or conductive pathway that extends a predetermined length LC from the reference plane $P_{REF}$. The conductive pathways may extend parallel to the surface $S_3$ and with respect to each other. The predetermined length LC may be different for each circuit contact 419 and represents a length that current must flow along the corresponding conductive pathway between the reference plane $P_{REF}$ and a corresponding conductor via 454. The arrows extending from the reference plane $P_{REF}$ indicate the conductive pathways through each circuit contact 419. In the illustrated embodiment, the conductive pathways extend parallel to each other and the surface $S_3$. More specifically, the conductive pathways associated with the circuit contacts −3 and +6 may extend a length $LC_1$ and have a phase measurement ($\phi_1$; the conductive pathways associated with the circuit contacts +2, −5, and +8 may extend a length $LC_3$ and have a phase measurement $\phi_3$; and the conductive pathways associated with the circuit contacts −1, +4, and −7 may extend a length $LC_2$ and have a phase measurement $\phi_2$.

Also shown, the circuit contacts −3 and +6 associated with the differential pair P2 extend a common length, the length $LC_1$, and in a common direction away from the reference plane $P_{REF}$. However, the associated circuit contacts 419 of the differential pairs P1, P3, and P4 may extend in different (e.g., opposite) directions away from the reference plane $P_{REF}$ and along different lengths. For example, the conductive pathways associated with the circuit contacts +2, −5, and +8 extend a greater length $LC_3$ than the length $LC_2$ of the conductive pathways of the associated circuit contacts −1, +4, and −7 respectively. As such, a phase imbalance may be created between the associated circuit contacts 419 of certain differential pairs. The phase imbalance may be configured to improve return loss of the connector. Furthermore, the phase imbalance may be configured to generate a desired amount of crosstalk coupling.

In alternative embodiments, the circuit contacts 419 do not extend directly alongside the surface $S_3$ of the substrate 442, but may still create the phase imbalance between the conductive pathways. Furthermore, in other embodiments, the circuit contact portions 252 and 352 may form similar conductive pathways and create similar phase imbalances as described with respect to the circuit contacts 419.

Figure 12:
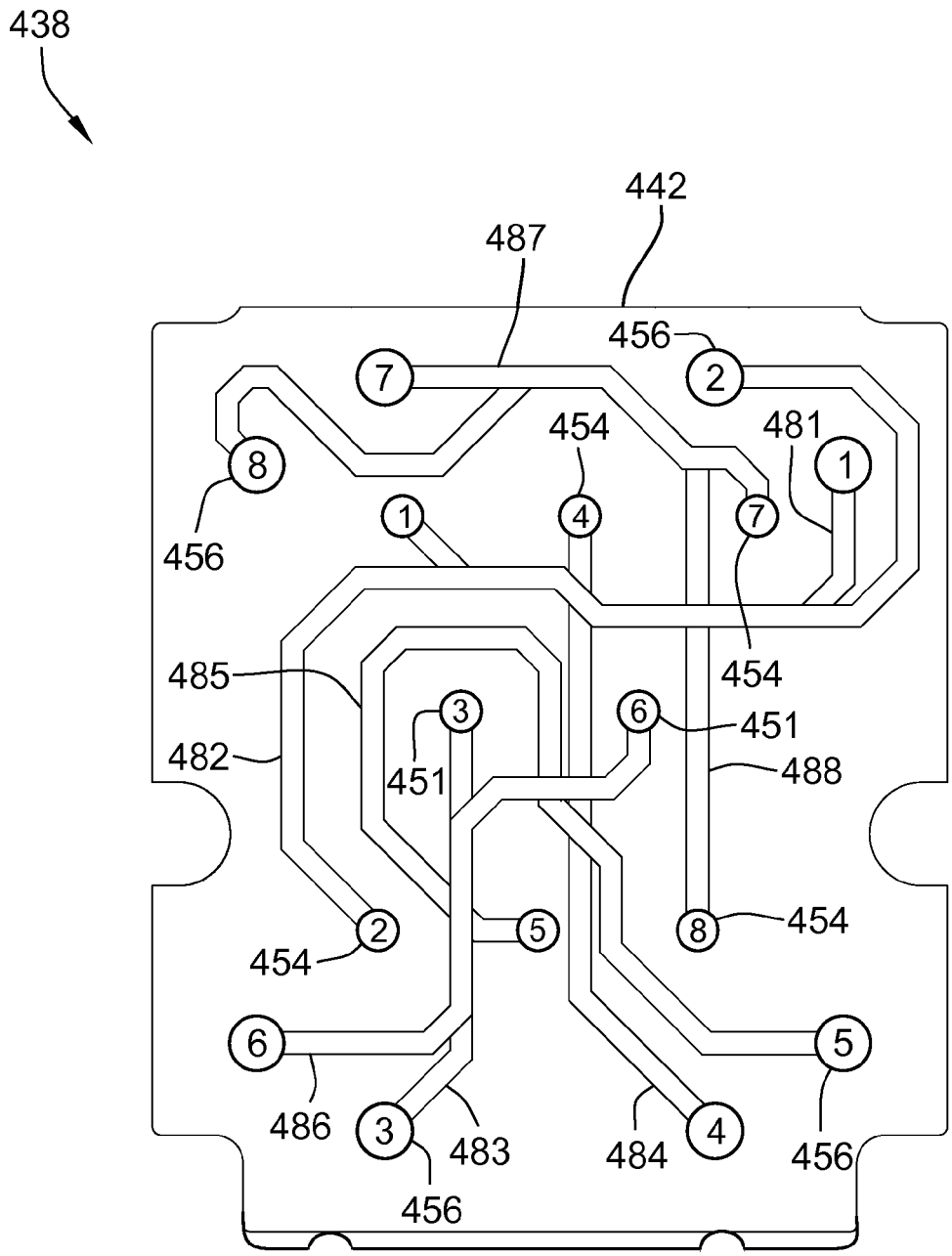
FIG. 12 is an elevation view of the printed circuit shown in FIG. 10 showing a plurality of traces extending therethrough.

FIG. 12 is a back elevation view of the substrate 442 of the printed circuit 438. The substrate 442 may include a plurality of traces 481-488 that interconnect the conductor vias 454 and shielded vias 451 to corresponding terminal contacts 456. The traces 481-488 may be configured to offset phase imbalances due to the arrangement and configuration of the circuit contacts 439 as shown in FIG. 11. More specifically, a length of the conductive pathways along the traces 481-488 may be configured to offset the phase imbalances. For example, the trace 481 may have a shorter conductive pathway than the trace 482; the trace 485 may have a shorter conductive pathway than the trace 484; and the trace 487 may have a shorter conductive pathway than the trace 488. However, in alternative embodiments, the traces 481-488 may have other configurations. Furthermore, the printed circuit 438 may include other components, such as non-ohmic plates or inter-digital fingers, that are configured to facilitate obtaining a desired electrical performance.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. For example, the coupling regions as described with respect to FIGS. 8-12 may or may not be used in conjunction with the arrangement of conductive and terminal vias as described with respect to FIGS. 5-7.

When introducing elements/components/etc. described and/or illustrated herein, the articles "a", "an" "the" "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electrical connector comprising:

an array of mating conductors configured to engage select plug contacts of a modular plug, the mating conductors comprising differential pairs;

a plurality of terminal contacts configured to electrically connect to select cable wires; and a printed circuit interconnecting the mating conductors to the terminal contacts, the printed circuit having opposite end portions and further comprising:

first and second shielding rows of conductor vias located between the end portions and electrically connected to the mating conductors, the conductor vias of each of the first and second shielding rows being substantially aligned along first and second row axes, respectively, the first and second row axes being substantially parallel to each other;

outer terminal vias electrically connected to the terminal contacts, each end portion having terminal vias therein that are distributed in a direction along the first and second row axes; and a pair of shielded vias electrically connected to corresponding mating conductors, the pair of shielded vias being located between the first and second shielding rows and located along a central-pair axis extending therebetween that extends substantially parallel to the first and second row axes, wherein the conductor vias of the first and second shielding rows are located to electrically isolate the shielded vias from the terminal vias.

2. The connector in accordance with claim 1 wherein the conductor vias include a differential pair of conductor vias, each conductor via of the differential pair being substantially equidistant from at least one of the shielded vias, the at least one shielded via forming a dual-polarity coupling with the conductor vias of the differential pair.

3. The connector in accordance with claim 2 wherein each of the first and second shielding rows includes one conductor via of the differential pair.

4. The connector in accordance with claim 2 wherein the differential pair of conductor vias is a first differential pair, the conductor vias further comprising a second differential pair of conductor vias, wherein the at least one shielded via forms a dual-polarity coupling with the conductor vias of the first differential pair and also a dual-polarity coupling with the conductor vias of the second differential pair.

5. The connector in accordance with claim 2 wherein the differential pair of conductor vias includes a first and second conductor vias, the first and second conductor vias being located first and second distances away, respectively, from the at least one shielded via, a difference between the first and second distances being at most 30% of one of the first and second distances.

6. The connector in accordance with claim 1 wherein at least one shielded via is substantially equidistant from the first and second row axes.

7. The connector in accordance with claim 1 wherein the terminal vias comprise a differential pair, the terminal vias of the differential pair being substantially equidistant from one of the conductor vias of the first or second shielding row.

8. The connector in accordance with claim 1 wherein the shielded vias are separated from each other by a distance that is less than shortest distances separating the shielded vias from the first and second row axes.

9. The connector in accordance with claim 1 wherein the terminal vias comprise differential pairs spaced apart from each other, the associated terminal vias of the differential pairs being positioned adjacent to each other.

10. The connector in accordance with claim 9 wherein the terminal vias of each differential pair are intersected by a corresponding plane, the planes of each of the differential pairs facing a center of the printed circuit, each plane facing a different direction with respect to other planes.

11. The connector in accordance with claim 10 wherein each plane faces one other plane across the center of the printed circuit.

12. The connector in accordance with claim 1 wherein the pair of shielded vias are electrically connected to a differential pair of mating conductors, the differential pair of mating conductors being split by another differential pair of mating conductors.

13. The connector in accordance with claim 1 wherein the mating conductors comprise adjacent mating conductors having respective coupling regions that capacitively couple to each other, the coupling regions being located proximate to the printed circuit, each coupling region has a side that extends along the thickness and faces the side of the coupling region of the adjacent mating conductor, wherein the thickness along each coupling region is greater than the width.

14. An electrical connector configured to electrically interconnect a modular plug and cable wires, the connector comprising:

a connector body having an interior chamber configured to receive the modular plug;

a printed circuit comprising a substrate having conductor vias; and an array of mating conductors in the interior chamber configured to engage select plug contacts of the modular plug along mating surfaces, the mating conductors extending between the mating surfaces and corresponding conductor vias of the printed circuit, the mating conductors having a cross-section including a width and a thickness, the mating conductors comprising adjacent mating conductors having respective coupling regions that capacitively couple to each other, each coupling region having a side that extends along the thickness and faces the side of the coupling region of the adjacent mating conductor, wherein the thickness along each coupling region is greater than the width.

15. The connector in accordance with claim 14 wherein the sides along the coupling regions have surfaces areas configured for a desired crosstalk coupling.

16. The connector in accordance with claim 14 wherein the adjacent mating conductors comprise separable circuit contacts coupled to the conductor vias of the printed circuit, the circuit contacts extending substantially parallel to a surface of the printed circuit and including the coupling regions.

17. The connector in accordance with claim 14 wherein the printed circuit has opposite end portions and further comprises:

first and second shielding rows of conductor vias located between the end portions and electrically connected to the mating conductors, the conductor vias of each of the first and second shielding rows being substantially aligned along first and second row axes, respectively, the first and second row axes being substantially parallel to each other;

outer terminal vias electrically connected to terminal contacts of the printed circuit, each end portion having terminal vias therein that are distributed in a direction along the first and second row axes; and a pair of shielded vias electrically connected to corresponding mating conductors, the pair of shielded vias being located between the first and second shielding rows and having a central-pair axis extending therebetween that extends substantially parallel to the first and second row axes, wherein the conductor vias of the first and second shielding rows are located to electrically isolate the shielded vias from the terminal vias.

18. The connector in accordance with claim 14 wherein the coupling regions form corresponding conductive pathways where current is transmitted therethrough, the conductive pathways extending parallel to a surface of the printed circuit and with respect to each other, the conductive pathways extending different lengths along the surface of the printed circuit.

19. The connector in accordance with claim 18 wherein the conductive pathways extend in different directions along the surface of the printed circuit.

20. The connector in accordance with claim 18 wherein the different lengths are configured to improve return loss.

* * * * *